US012235021B1

(12) United States Patent
Chambers, Sr. et al.

(10) Patent No.: US 12,235,021 B1
(45) **Date of Patent: *Feb. 25, 2025**

(54) METHOD OF CONTROLLING TENSILE-SPLITTING AND HYDRO-SHEARING PARAMETERS DURING COMPLETION OF ENHANCED GEOTHERMAL SYSTEM WELLS

(71) Applicants: Michael Roy Chambers, Sr., Lindale, TX (US); Timothy David Gray Hillesden Lines, Hayling Island (GB); Carl Bradley Pate, Fort Smith, AR (US); Robert Mansell Pearson, Calgary (CA); Abdell Wadood M El-Rabaa, Plano, TX (US)

(72) Inventors: Michael Roy Chambers, Sr., Lindale, TX (US); Timothy David Gray Hillesden Lines, Hayling Island (GB); Carl Bradley Pate, Fort Smith, AR (US); Robert Mansell Pearson, Calgary (CA); Abdell Wadood M El-Rabaa, Plano, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/732,816

(22) Filed: Jun. 4, 2024

Related U.S. Application Data

(63) Continuation of application No. 18/644,250, filed on Apr. 24, 2024, now Pat. No. 12,140,344.
(Continued)

(51) Int. Cl.

| | |
|---|---|
| ***E21B 43/26*** | (2006.01) |
| ***E21B 41/00*** | (2006.01) |
| ***F24T 50/00*** | (2018.01) |

(52) U.S. Cl.
CPC ..... *F24T 50/00* (2018.05); *E21B 41/0035* (2013.01); *E21B 43/26* (2013.01); *E21B 2200/22* (2020.05)

(58) Field of Classification Search
CPC ..... F24T 50/00
See application file for complete search history.

(56) References Cited

U.S. PATENT DOCUMENTS

| | | | | |
|---|---|---|---|---|
| 2014/0048270 | A1* | 2/2014 | Soliman | E21B 43/26 166/308.1 |
| 2016/0230526 | A1* | 8/2016 | Crews | E21B 43/26 |
| 2018/0080309 | A1* | 3/2018 | Althoff | E21B 43/17 |

OTHER PUBLICATIONS

Schlumberger Oilfield Glossary Proppant Accessed 2024 https://glossary.slb.com/en/terms/p/proppant (Year: 2024).*

* cited by examiner

*Primary Examiner* — David Carroll
(74) *Attorney, Agent, or Firm* — Tumey L.L.P.; Eric Adams; Tod T. Tumey

(57) ABSTRACT

Methods and systems for geothermal energy production wherein multiple horizontal or vertical wells may be used to pass fluids through the Earth from an injector well to a producer well through induced cracks, splits, fractures, conduits, or channels in the rock. Such methods and systems may include controlling tensile-split conduits in a subterranean geothermal formation by providing an injection well, providing a production well, configuring the injection well for injection of a tensile-splitting fluid into a production zone, configuring the production well to produce a heated fluid from the production zone, applying pressure to the production well, creating a plurality of tensile-split conduits, raising or lowering the pressure in the production well,
(Continued)

establishing fluid communication between the injection well and the production well, and producing the heated fluid to the surface.

11 Claims, 33 Drawing Sheets

Related U.S. Application Data

(60) Provisional application No. 63/540,435, filed on Sep. 26, 2023, provisional application No. 63/535,469, filed on Aug. 30, 2023.

| 570 Injector | 575 Producer |
|---|---|
| **1. Have Pumped design volume and not intersected Producer**<br>• Pump Diverter Materials<br>• Increase pump rate in injector<br>• Increase viscosity of fluid (x-link)<br>• Decrease viscosity of fluid<br>• Pump twice design volume, no contact - move to next location | • Lower Bottom Hole Pressure (BHP) - Monitor<br>• Raise Bottom Hole Pressure - Monitor |
| **2. After Communication**<br>• Pump proppant or swell material | • Monitor for proppant<br>• Raise BHP to increase width of fracture<br>• Reduce BHP to decrease width of fracture and capture proppant at formation face |
| **3. Poor injectivity test**<br>• Restart frac with pad<br>• Pump higher concentrations of proppant than first attempt<br>• Increase Pump rate and fluid viscosity | • Flow well and monitor for proppant, raise and lower choke to understand affect on injector stimulation pressure<br>• Raise or lower BHP as required to affect fracture width and height |

FIG. 12

METHOD OF CONTROLLING TENSILE-SPLITTING AND HYDRO-SHEARING PARAMETERS DURING COMPLETION OF ENHANCED GEOTHERMAL SYSTEM WELLS

CROSS-REFERENCE TO RELATED APPLICATIONS

This application claims priority to U.S. patent application Ser. No. 18/644,250 filed on Apr. 24, 2024, which claims priority to U.S. Provisional Application No. 63/535,469 filed on Aug. 30, 2023, and U.S. Provisional Application No. 63/540,435 filed on Sep. 26, 2023, which are all herein incorporated by reference in their entirety.

BACKGROUND

1. Field of Inventions

The field of this application and any resulting patent is methods and systems for geothermal energy production. More specifically, methods and systems for energy or mineral production wherein multiple horizontal or vertical wells may be used to pass fluids through the Earth from an injector well to a producer well through induced cracks, splits, fractures, conduits, or channels in the rock.

2. Description of Related Art

Various methods and systems have been proposed and utilized for geothermal energy production, including some of the methods and systems disclosed in the references appearing on the face of this patent. However, those methods and systems lack all the steps or features of the methods and systems covered by any patent claims below. As will be apparent to a person of ordinary skill in the art, any methods and systems covered by claims of the issued patent solve many of the problems that prior art methods and systems have failed to solve. Also, the methods and systems covered by at least some of the claims of this patent have benefits that could be surprising and unexpected to a person of ordinary skill in the art based on the prior art existing at the time of invention.

Large quantities of heat are captured in the Earth's subsurface formations. From the surface to the Earth's core the temperature increases. It is an almost inexhaustible source of energy.

There are many uses for the Earth's heat from home or industrial heating to electricity generation. Generating electricity, however, requires temperatures which will boil fluids and generate vapor to turn turbines to turn generators. This process is not very efficient but can be improved by using even higher temperatures and new power fluids within the many variants of Organic Rankine Cycle (ORC), Brayton Cycle and other heat-to-electricity-generation methods.

Due to the economics of extraction, historically conventional methods to capture and use this heat for electricity generation have been limited to relatively shallow but hot rocks containing a network of natural fractures usually containing naturally flowing water. These types of source rocks are relatively few globally, residing near subduction and volcanic zones such as found in California, Nevada, Indonesia, and Iceland where convection and advection of water at deeper horizons transports heat to shallower fractured networks.

Deep in the Earth, typically below sediment layers, reside rocks which are impermeable and are not fractured, like obsidian (basically glass). There are also many impermeable rocks like granite, basalt, and granodiorite which contain micro fractures and are essentially available everywhere in the world.

There are two primary methods being proposed to access this deep hot source of energy: Closed Loop (collectively named "Advanced Geothermal Systems," AGS), where fluids are circulated within, or proximate to, a single well, and "Enhanced Geothermal Systems" (EGS) where fluids are exchanged between wells. Even if an EGS method were planned for the final completion, the well may be arranged in an AGS configuration and the system tested to gather reservoir data. This could be done while the rig is drilling additional wells.

The Closed Loop method typically requires hotter temperatures than EGS due to its smaller footprint to extract heat from the Earth before it depletes the near well area to unusable temperatures. Tensile-splitting conduits or drilled laterals (branches) may be added to the main well to improve heat transfer from the far field back to the main well. U.S. Patent Publication 2023/0120246 discusses a system comprising a thermal enhancement structure that has longitudinal complex multi-fractured geometry where the structures are filled with thermally conductive cement and fillers.

EGS methods involve injecting fluids through tensile-splitting the two rock planes to create conduits and by hydro-shearing to reopen in-situ micro fractures (sometimes referred to as frac'ing, or cracking, or simply shearing), in typically impermeable formations, between wells to capture heat. The hydro-shearing method of EGS has also been used to improve conventional naturally fractured reservoirs.

Creating conduits between the wells provides flow paths for fluids to move and come in contact with the hot formations. For the same reservoir depth and diameter and length of well bores, EGS accesses and extracts heat over a much larger area than AGS. As a result, EGS exhibits a much smaller (semi)-steady-state temperature drop from the bulk reservoir to the near-well region of the producer wells, compared to AGS.

Two common methods for tensile-splitting the rock to create conduits are: (1) the plug and perf (P&P) method, where clusters of perforations (for example 4 clusters of perforations) are treated simultaneously; and (2) the sleeve method (SM), where typically one single shear conduit at a time is created through holes in the body of a single sliding sleeve, or single set of perforations.

An advantage of the P&P method is the well can be completed quickly. A disadvantage is that typically more than one foot (30 cm) at each cluster is perforated, and this may lead to multiple shorter conduits being generated, rather than the intended one long conduit.

An advantage of the SM method is a more precise treatment for each shear entry point as well as less surface equipment, and thus a smaller surface footprint is required to execute the process. Furthermore, since only a short section of the well is exposed, it will generate only one and thus a longer conduit.

Recently, Fervo Energy in its Blue Mountain Geothermal Field, Nevada, drilled two horizontal wells (Injection Well 34A-22 and Production Well 34-22) parallel to one another approximately 360 feet apart in a 360-degree fahrenheit hot reservoir for geothermal heat extraction. Fervo then used the conventional plug and perf method of shale fracturing to create a network of induced fractures between the wells. This fracture network method is created by conduits (shear planes) which start at each well. The hope is the conduits will intersect or create a secondary network of perpendicular conduits to connect them. In the Fervo example, Injector Well 34A-22 was drilled and tensile-split shear conduits were installed before drilling the second well 34-22 intended to be the producer. In Fervo's paper entitled "A Review of Drilling, Completion, and Stimulation of a Horizontal Geothermal Well System in North-Central Nevada," the authors referred to this area between the two wells as the "Stimulated Rock Volume" or SRV. International Publication No. WO2013/169242 also discloses using two parallel stimulated horizontal wells for geothermal heat extraction and refers to the area between the wells as a "Production Sub Zone."

In EGS methods there are at least two wells. One well is typically the injector where cooler fluids are pumped from the surface and exits the injector well to encounter the hot rock, and the second well is typically the producer where the now-heated fluids exit the rock to enter the producer well and return to surface. However, additional producers and injectors may be added depending on the amount of thermal power required by the development and the amount of heat energy that is to be recovered.

There are two primary methods for creating flow paths between injectors and producers. The first method is to tensile-split both the injector and producer creating separate conduits from each well. In between the wells the fractures may intersect or otherwise come into communication due to additional smaller fractures created like the branches of a tree. Hydro-shearing may be able to reopen the in-situ fractures and allow communication between separate tensile-split conduits. In this method, typically the injector and producer are cased and cemented. This method is referred to as the "Fracture Exchange Network" (FEN).

An example of this method is described in the Fervo paper previously mentioned. It is difficult to tensile-split granite type rocks, and the resulting conduits tend to be shorter and less contained than in layered sedimentary rock sequences (which typically restrict vertical fracture growth). When trying to extract heat from an area greater than about 350 feet between wellbores, an advantage of the FEN method is it is easier to create two intersecting conduits from an injector-producer pair of wells than it is to create one long conduit. Hence the FEN method creates a larger area to extract heat.

The second method is to tensile-split and create a conduit directly from the injector to intersect the producer. In this method, typically the injector is cased and cemented to control where the fracture is created, but the producer is left open hole (not cemented) or has an uncemented liner (steel tubing). This allows a much larger area for the fracture to intersect the well. This method is referred to as the Direct Contact Method (DCM). An example of this method is described in SPE paper SPE-210210-MS entitled "Development of Multi-Stage Fracturing System and Wellbore Tractor to Enable Zonal Isolation During Stimulation and EGS Operations in Horizontal Wellbores." An advantage to this method is there is better assurance that the conduits between the injector and producer provide effective fluid transmission and pressure communication.

Tensile-splitting from one well to create a conduit that intersects another well ("a frac hit") is something that has been avoided in the oil and gas industry since inception (in direct contrast to frac hits being the planned outcome of EGS tensile-splitting). Methods like those discussed in SPE 194333 (Konstantin Vidma et al., "Fracture Geometry Control Technology Prevents Well Interference in Bakken") and U.S. Pat. No. 10,683,740 to prevent frac hits or intersections are common. Likewise fracturing in the oil and gas industry has targeted low permeability rocks to provide flow channels back to the parent well. However, in EGS tensile-splitting, the rock may have little to no permeability or porosity and therefore behaves differently. However, loss of injection water ("leakoff") has been observed when tensile-splitting these types of formations, indicating that some contain natural micro fractures.

The term Sealed Wellbore Pressure Monitoring (SWPM) has been termed in the shale industry to track frac hits in multiple wells. Thus, methods to avoid frac hits have been proposed. However, methods to encourage the intersection and fluid communication have not been required of shale or conventional oil and gas production.

The following are four methods proposed for oil and gas wells that could be used in EGS methods to keep open the flow channel/conduit network.

The first method is to emplace proppants like sand, resin-coated sand, and/or bauxite dependent on the overburden stress. (Stress is defined herein as the force acting on the unit area of a material. It is a second order tensor and can be decomposed into nine components). This is the method used by Fervo as mentioned above. This method is referred to herein as the "Conventional Method."

The second method is disclosed by Dr. Carlos Fernandez in 20150217 PNNL EGS (DOI: 10.1039/c4gc01917b) Polymer paper and U.S. Pat. No. 9,873,828, wherein he proposes expandable polymers combined with carbon dioxide to expand the fracture opening (hereinafter, the "Fernandez Method"). Fernandez's above patent proposes using proppant to keep the fracture open, but this may not be required, or only in reduced quantities compared to the Conventional Method. The Fernandez Method, due to the triggered expansion of the treatment fluid and/or the effect of pumping cold fluids on the hot rock, may create an uneven sheared surface that still provides an effective flow path/conduit after the pressure is released. The Pacific Northwest National Laboratory has trademarked the name STIMU-FRAC™ for this expansion fluid method.

The third method has been proposed by Nevels in U.S. Publication No. 2019/0323329 entitled "Fracture Formation with a Mortar Slurry." In this method, mortar or cement is added to the fluid used to split the rock. After placement it may set to allow fluids to flow as long as it is permeable or has etched surfaces interacting with the formation.

The fourth method is to maintain liquid or super-critical fluid pressure on the fracture to keep it open, whilst not increasing its dimensions; this is possible because the pressure required to hold open a fracture is less than that required to increase its dimension. In essence, this method simply replaces proppant with pressure.

The above proposed methods focus on controlling the fracturing parameters from the injection well alone.

The Closure Stress for granite-type formations worldwide is on the order of 0.66 psi/ft. It is difficult to tensile-split this rock and generate an aperture between the split rock faces of more than 4.0 mm. These formations are typically vertically very thick, and so lack other formations above or below to stop vertical fracture growth. Therefore, tensile-split conduits created in granite type formations are typically approximately circular ("penny-shaped"), i.e., of similar height and length. In these types of formations, it is also difficult to create split radii much greater than 350 feet, and hence it is very important to manipulate this process as much as possible to achieve the optimum conduit parameters of height, aperture width, and length. The methods of achieving this are discussed below.

Pressures can be applied directly to the rock face through cemented and open hole wells. In cased and cemented wells, it is difficult to induce stress further away than 20 to 30 times the casing diameter. By contrast, in open holes any stress applied is transmitted far into the rock.

Altering stresses in one well whilst tensile-splitting a second well materially affects the direction of the conduits generated by the second well. If not executed correctly the conduits may veer away from the first well and fail to establish flow paths between the wells.

In SPE 17533 by Warpinski ("Altered Stress Fracturing" in the Journal of Petroleum Technology, September 1989, pp. 990-996), the author shows fractures propagating from one well were perpendicular to the usual direction, when simultaneously fracturing two nearby vertical wells.

Once a formation has been tensile-split, if the resulting conduit were subsequently propped this would permanently change the stress state of the formation. To avoid the direction-altering influence of this changed stress state, any new tensile-split conduit must be initiated at a horizontal distance along the lateral well that is at least half the distance into the formation of the diameter or major axis of the previously created conduit.

In summary, applied stresses must be applied at the correct location, and time in both injector and producer wells to create the desired intersection of conduits between them.

The following is a worked example: Stresses adjustment around fracture initiated and kept inflated by pressure Po can be assessed by (SPE 17533):

$$1/2(\sigma_x+\sigma_y) = -p\left\{\frac{L}{\sqrt{L_1L_2}}\times\cos[\theta-1/2(\theta_1+\theta_2)]-1\right\}, \quad (1)$$

$$1/2(\sigma_y-\sigma_x) = p\left\{\frac{L\sin\theta}{h/2}\left(\frac{h^2/4}{L_1L_2}\right)^{3/2}\times\sin\left[\frac{3}{2}(\theta_1+\theta_2)\right]\right\}, \quad (2)$$

$$\tau_{xy} = -p\left\{\frac{L\sin\theta}{h/2}\left(\frac{h^2/4}{L_1L_2}\right)^{3/2}\times\cos\left[\frac{3}{2}(\theta_1+\theta_2)\right]\right\}, \quad (3)$$

$$\text{and } \sigma_z = \mu(\sigma_x+\sigma_y), \quad (4)$$

Fracture rotation from injector will follow: a=½*tan−1 ($\tau_{xy}$/(S1−S2)). The distance B should satisfy 10 deg fracture rotation, therefore: $\tau_{xy}$/(S1−S2)~0.364, where $\tau_{xy}$ is shear stress induced by fracture in cartesian coordinates;

And new effective stress S1=Shmin−Sx; S2=Shmax−Sy;

P is the internal fracture treatment pressure above closure;

h is the fracture height;

L is distance from center of fracture to point;

L1 is distance from negative fracture tip to point;

L2 is distance from positive fracture tip to point;

x, y, z cartesian coordinates;

Θ is angle from center of fracture to point;

$\Theta_1$ is angle from negative fracture tip to point;

$\Theta_2$ is angle from positive fracture tip to point;

(σH)max maximum horizontal principal in-situ stress;

(σH) min minimum horizontal principal in-situ stress;

σx, σy, σz stresses induced by fracture in Cartesian coordinate directions;

σ1, σ2, σ3 stresses in reservoir layers;

and the geometric relations are given by:

$$L=(x^2+y^2)^{0.5}$$

$$\Theta=\tan^{-1}(x/-y)$$

$$L_1=(x^2+(y+h/2)^2)^{0.5}$$

$$\Theta_1=\tan^{-1}[x/(-y-h/2)]$$

$$L_2=x^2+(y-/h/2)^2)^{0.5}$$

$$\Theta_2=\tan^{-1}[x/(h/2-y)]$$

Negative values of Θ, $\Theta_1$, and Θ2 should be replaced by Π+ Θ, Π+ $\Theta_1$ and Π+ $\Theta_2$, respectively.

SUMMARY

The embodiments disclosed herein relate to geothermal energy production, but, more generally, to any energy or mineral production where multiple horizontal or vertical wells are used to pass fluids through the Earth from an injector well to a producer well through induced cracks, splits, fractures, conduits, or channels in the rock. The embodiments disclosed herein also relate to geothermal energy production (and any other energy or mineral production) where there is more than a single injector and producer well. More specifically, the embodiments relate to how the flow paths or conduits between the injector(s) and producer(s) may be constructed. The embodiments are based on the understanding that rock stresses may be altered during tensile-splitting and hydro-shearing processes and that previous in-situ fractures may have altered the pre-stimulation rock stress.

Altering the rock stress in one well either before and/or during the tensile-splitting treatment in a second well may affect the in-situ reservoir rock stresses and improve or impede the ability of a shear-plane/conduit to grow towards or away from the first well.

From rock mechanics theory it can be shown that increasing the rock stress in a well oriented 90 degrees to the least principal stress of a rock formation may cause the generated shear plane from a second well undergoing tensile-splitting to favor growing in the direction of the first well. However, if the induced stress from the first well is too high this may cause the shear plane to turn and grow parallel to the first well. Furthermore, lowering the wellbore stress in a well may also cause the shear plane to not intersect it.

In one embodiment two wells (an injector and a producer) with parallel, and facing, horizontal hole-sections ("laterals") may be constructed in a geothermal heat reservoir. The horizontal hole section in one, the injector, may have inserted along its full horizontal length a steel tube (a "liner"), which is cemented to the rock. In the other, the producer, the horizontal hole section may be open or may have a liner inserted, but cement may not be placed in the horizontal hole. Prior to the start of the tensile-splitting operation in the injector, water may be pumped into the producer well to raise the pressure in the horizontal hole to just below the rock fracture (split) pressure; this may increase the stress at the producer and further into the rock near the producer.

During the tensile-splitting operation from the injector, the pressure in the producer may be monitored to determine when the induced shear on the formation created by pumping in the injector has intersected the producer. This may be seen by a dramatic pressure increase in the producer.

Once communication has been established (by noting increased pressure or another method) the operator has the ability to increase the pressure in the producer (or producers if there are more than one in proximity of the injector); decrease the pressure in the producer(s); or remove fluids, lowering the hydrostatic bottom hole pressure or surface pressure from the producer(s) so the pressure remains constant or is lower or higher. This pressure control may have a direct impact on the formation and progression of the tensile-splitting of the rock from the injector. For example, lowering the pressure in a producer may cause the conduit approaching that producer to stop growing and cause a conduit further away from that producer to grow, potentially improving the ability of a conduit from the injector to intersect one or more other producers.

In another embodiment, allowing water from a producer to flow to the surface could allow for improved proppant placement between that producer and the injector, as this may cause proppant-laden water from the injector to move in the direction of the producer.

Furthermore, the fluid injection rate in the injector may be varied once communication through conduits has been proved in one or more producers. By such means, the emplacement of plugging agents and fluid loss materials and the cross-linking of injected gels may be carefully controlled by pumping fluid from the injector and monitoring the effect on the producer(s).

If sand or other proppants are pumped in the injector to keep the conduits open permanently without applied water pressure, monitoring the flow in the producer using downhole fiber or other methods may allow the operator to optimize the tensile-splitting and hydro-shearing designs and to ensure sufficient proppant has been placed in the tensile-split conduits and any newly opened in-situ conduits.

Additionally, at the end of the stimulation, the pressure in the producer may be reduced to the anticipated production pressure and an injectivity test performed in the injector. If an insufficient rate is achieved, the zone may be restimulated and additional proppant placed, or other stimulation parameters altered.

If expandable fluid systems like those described by Fernandez above are used, the required fluid injection pressure in the injector may be much lower than the Common Method; and carbon dioxide or other activators may also be pumped into the producer to contact and swell the fluid near the producer. Likewise, carbon dioxide or another activator may be injected into the conduit from the producer.

To improve injection control in the producer, sections of the well may be segregated through the use of open hole packers and ported sleeves to limit the area being contacted by internal pressure or frac hits generated from the injector.

The above methods may be applicable in the following instances: using the single sleeve or plug and perf completion method targeting a single or multiple fractures; a variation/combination of the two methods; and any other method where monitoring of the conditions in the producing well may result in changes made to the injection well treatment.

As mentioned previously, many reservoirs contain in situ natural fractures. However, due to faulting and tectonic stresses there may be areas of the same reservoir at the same depth that do not contain fractures. The EGS methods and techniques described herein are applicable to both. In a preferred embodiment there is a reservoir that has areas containing a population of in situ tectonically produced fractures while other areas may be devoid of such fractures. A horizontal lateral well may be drilled through the reservoir intersecting both regimes. In the non-fractured section methods described utilizing the FEN method or the DCM method may be used. However, in the fractured area many of the same techniques described to control fracture growth by manipulation of pressures in offset lateral wells may also be used to reactivate and connect the fracture systems between the two or more laterals.

Prior to or once the first tensile-splitting operation has been performed, computer software and artificial intelligence methods may be used to monitor the treatment data to suggest changes to the creation and ultimate conductivity of the conduits.

Artificial Intelligence (AI), Machine Learning (ML) and Large Language Models (LLM) can customize and optimize EGS Completions and Operations. Conventionally the system designer must try to take data from many different sources and use many different software and learnings to develop a development plan. Geologic rock properties and in situ fracture knowledge must be integrated with heat flow modeling, wellbore sizes, induced fracture design, circulation rates and fluid distribution along the lateral, to optimize the optional number of wells/laterals for the required amount of energy needed and lifespan of the project, whilst simultaneously minimizing the total project cost and parasitic loads and operating costs for a given amount of heat produced. With the correct programming AI can access the global on-line repository of software and LLMs and deploy these to integrate geologic, stimulation, operational, and financial models and data to determine the optimum design. In a preferred embodiment AI, ML, and or LLM are used to optimize the design and development of an EGS completed geothermal reservoir wherein the optimum operational and financial conditions are met.

There are three primary methods to monitor the tensile-splitting treatment in the producer. The first may be to attach pressure, radioactive, noise, or other sensors to the producer's casing. Data may then be gathered by wire, fiber, RFID Tag, or other means. The second method may be to attach sensors to coiled tubing or wireline run from the surface inside the production casing to the "toe" of the horizontal section. Data from the sensors (such as pressure, radioactivity, noise, and other) may then again be collected by either a wire, fiber, RFID tag, or other means. The third method may be to use micro-seismic sensors in the producer or in a nearby offset well.

The heat collecting and stress altering properties of a matrix of achievable distances between created tensile-split conduits and intersecting wells may be determined by computer modeling, for different circulation rates. This modeling may yield the optimum project economics of well life before fluids fall below the temperature threshold required to generate electricity or satisfy a direct heat specification. This distance is also designed to minimize interaction between the newly altered stress state of the rock.

Induced fractures are depicted herein in many places as being vertical. However, due to tectonic stresses especially in deep hot reservoirs created by narrow depths to magma or in areas where plate tectonics has created localized changes in stress-fields the fractures may be tilted in any orientation. Localized stresses may for example grow fractures at a 45-degree angle versus a 90-degree angle. In a preferred embodiment the placement of the horizontal laterals rather than being at the same vertical depth may be altered where one is higher or lower than the other to improve the intersection of induced fractures and/or the intersection with another horizontal lateral.

Likewise, this newly created conduit network between wells may be used as a method to create a pressurized reservoir storage system. In embodiments, at appropriate times excess fluid pressure may be released from the wells to produce fluids to the surface to turn hydro turbines to generate electricity. This power may be used initially to run pumps to bring the system to a heated condition to run steam turbines.

Fluid temperatures selected for stimulation may influence the effectiveness of tensile-splitting and hydro-shearing. Cooling the rock may apply additional stress to the rock. Either circulating fluid in the producer to cool it during the stimulation or cooling injection fluids in the injector may have a beneficial effect on the creation of conduits and also may reduce the Darcy skin factor of the wells by creating near-wellbore fracture networks.

By using either the DCM or FEN process detailed herein heated fluids will be returned to the surface. These superheated fluids may then be used for multiple processes including the generation of electricity through the direct steam flash processes, or using a binary cycle whereby the fluids are passed through a surface heat exchanger to transfer heat to a working fluid to be used directly by heat consumers; and/or to generate electricity using the Rankine, Brayton and other vapor cycles; and/or to convert to process steam; and/or to manufacture substances like Hydrogen, Ammonia, or synthetic fuels derived via for example the electrochemical syngas and thermal Fischer Tropsch processes. If the temperature of the fluids is too low to meet a specific industry specification, it may be supplemented by other sources of heat derived from electricity or from fuels like methane or propane to reach the required temperature. In addition to water, other fluids such as supercritical $CO_2$ may either be used independently or in conjunction with water as the fluid circulated through the earth to extract geothermal energy. In a preferred embodiment two or more horizontal wells may be exchanging fluids between injector(s) and producer(s). These fluids may transfer their heat to another fluid via a surface heat exchanger, or be used directly, or be supplementally heated with another source and used directly or used in combination with the syngas and Fischer Tropsch processes to reach the desired outcome.

Turning now to the FEN method, in other embodiments, two wells with parallel, and facing, horizontal hole-sections ("laterals") may be constructed in a geothermal heat reservoir. The horizontal hole section in one, the injector, may have inserted along its full horizontal length a steel tube (a "liner"), which may be cemented to the rock. In the other, the producer, the horizontal hole section may have inserted along its full horizontal length a steel tube ("liner"), which may also be cemented to the rock. The tensile-splitting conduit formation operation may be started and pumped from the injector or the producer first. The entire planned conduit formation operation may be designed to extend slightly more than half the distance separating the wells. At the conclusion, pressure may be bled to just below the shear-splitting extension pressure but still above the hydro-shearing pressure, so keeping open the conduits. The placement of the perforations in the second well should be as close to a perpendicular line intersecting the first well's stimulation as possible. Distances off this line of greater than approximately 20 feet may result in no intersection of the conduits. The stimulation in the second well should contain sufficient fluid and pumping power to extend more than half the distance separating the two wells. Pressure may be monitored in the opposing well until communication is observed. At this point, proppant, expansion fluids, permeable cement, or another method may be used to prop, and hence leave open, the newly created conduit between the wells. When sufficient fluid has been pumped, or proppant or other material noted in the producer, the operation may be halted and pressures bled.

If difficulty is experienced with connecting conduits between the two wells, the fluid viscosity and the fluid pump rate may be varied. If difficulty continues, fracture plugging or diverter or plugging materials may be added. If still unsuccessful, further attempts may be discontinued and the operation moved to the next well section. At this point attempts should be made to align the initiation points closer. Stimulation volumes should also be increased. It may also be necessary to conduct a mini-frac to assess formation leak-off, height and other properties.

Tensile-stress initiation points along the horizontal section of the well should ideally be no closer than the distance of the length of conduit created between the wells to ensure the new stimulation is in an area of unaltered stress. For example, if the distance between the parallel wells is 400 feet and the designed tensile-stress conduit extends 250 feet towards the other well, then the horizontal distance along the well between conduits should ideally be no less than 250 feet. However, if the difference between the maximum and minimum rock tensile stresses is low, the horizontal separation distance between the conduits may be reduced below the above guideline to better remove heat from the reservoir. When well pressure approaches the planned production circulation pressure, a flow test may be performed by pumping at the desired production rate to establish whether an economic mass flowrate of water can be achieved.

In the EGS method of heat extraction from the earth one of the primary controlling factors is the pumped fluid circulation rate from the injection wells, through the fractures and back up the production wells to the surface. The pump power required to overcome frictional losses from injecting and producing fluid at a given circulation flowrate is a function, amongst other, of the internal diameter of the steel casing/tubing through which the fluid flows. Hence, for a given circulation flowrate, parasitic power and parasitic energy requirements (defined as the amount of power & energy spent to extract the heat from the reservoir, and of which this pump power is the most significant) can be reduced by increasing the diameter of the tubing/casing. Although oil and gas production casings are typically 7" or smaller, in geothermal developments sizes of 13⅜" or 16" may become commonplace to balance the lower frictional power losses and higher capital costs of larger sizes to optimize the profitability of the development. Likewise different sizes may be used in combination to refine this balance. Similarly, friction-reducing chemicals may also be added to reduce the parasitic loads. In a preferred embodiment, a string of 9⅝" casing is used as a liner in a horizontal lateral in conjunction with a string of 16" intermediate casing to reduce heat gathering circulation rates. In the same embodiment friction reducing chemicals may be added to the fluid stream to further reduce friction-related horsepower requirements. In another preferred embodiment large submersible pumps or other forms of pumping equipment may be inserted in the large intermediate production casing wellbore to further reduce friction pressures.

One or more specific embodiments disclosed herein includes a method of controlling tensile-split conduits in a subterranean geothermal formation, comprising the following steps: providing an injection well extending from a surface to a subterranean geothermal formation, wherein the injection well comprises a plurality of cemented casing sleeves, wherein each of the plurality of cemented casing sleeves is capable of being opened, closed, or choked;

providing a production well extending from the surface to the subterranean geothermal formation, wherein the production well comprises an uncemented liner, wherein the uncemented liner comprises a slotted/predrilled liner; configuring the injection well for injection of a tensile-splitting fluid into a production zone, wherein the production zone is defined within the subterranean geothermal formation, and further wherein the production zone requires tensile-splitting to enhance fluid conductivity; configuring the production well to produce a heated fluid from the production zone; applying pressure to the production well at a pressure below the tensile-splitting initiation point, wherein the shear stress is increased in the maximum horizontal stress direction and a tensile-splitting conduit is encouraged to intersect the production well; creating a plurality of tensile-split conduits by injecting the tensile-splitting fluid into the production zone of the injection well, and further wherein each of the plurality of tensile-split conduits intersects the production well; raising or lowering the pressure in the production well in response to acquired real-time data during the tensile-splitting operation, wherein the raising or lowering of the pressure in the production well facilitates changing the height, width, and/or length parameters of the induced plurality of tensile-splitting conduits, and further wherein the pressure is raised in the production well by pumping a pressure fluid into the production well while simultaneously pumping the pressure fluid into the injection well, and further wherein the pressure is lowered in the production well by lowering the hydrostatic level by employing a pump, jetting, or flowing, and further wherein the real-time data comprises pressure, temperature, seismic information, or a combination thereof, wherein the real-time data is input into a computer equipped with artificial intelligence; establishing fluid communication between the injection well and the production well by imposing a hydraulic pressure above the hydro-shear pressure and below the tensile-splitting pressure on the plurality of tensile-split conduits, wherein the plurality of tensile-split conduits are maintained in an open condition, in order to extract heat by circulating a supercritical carbon dioxide between the injection well and the production well; and producing the heated fluid to the surface, wherein the heated fluid is employed as direct heat, for electricity generation, or for creating energy carrier fluids.

BRIEF DESCRIPTION OF THE DRAWINGS

FIG. 12 presents methods proposed to be employed in injectors and producers when certain conditions have not been met.

DETAILED DESCRIPTION

1. Introduction

Figure 1A:
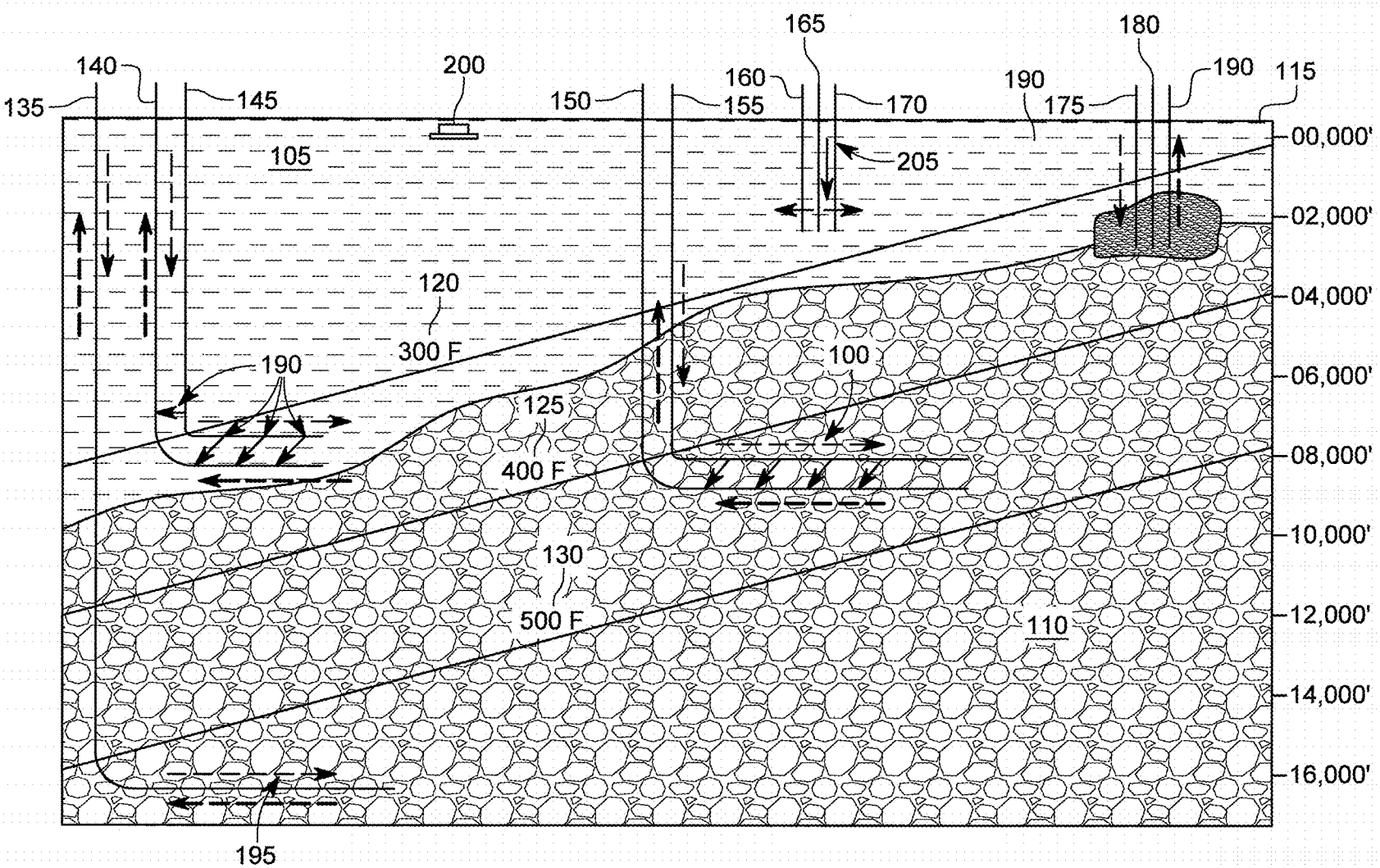
FIG. 1A is an illustration of embodiments of multiple geothermal systems.

A detailed description will now be provided. The purpose of this detailed description, which includes the drawings, is to satisfy the statutory requirements of 35 U.S.C. § 112. For example, the detailed description includes a description of the inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details of the systems, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in any printed publication, dictionary, or issued patent.

The embodiments disclosed herein disclose novel approaches to extracting geothermal heat and/or minerals from deep beneath the Earth's surface. For example, in embodiments tensile-splitting or hydro-shearing the rock between an injector well and one or more producer wells may occur simultaneously in order to connect these wells to one another with flow conduits. In other embodiments involving an injector well and a plurality of producer wells, the flow conduits being created may be steered in specific directions towards specific wells. Additionally, in other embodiments an injector well and a producer well may have multiple conduits, and control over the flow of fluids through each conduit may be controlled independently of the other conduits. Plus, in embodiments tensile-splitting and hydro-shearing to establish flow conduits between an injector well and one or more producer wells may be accomplished in granites and other crystalline and volcanic rocks, metamorphic rocks, naturally and artificially cemented solid materials, and sedimentary rocks and shales. These are merely some of the unique aspects of the embodiments disclosed herein. Further, the embodiments disclosed herein substantially decrease the risk and cost of extracting heat and/or minerals from impermeable or low-permeability rock that needs to be tensile-split or hydro-sheared to enable extraction fluids to be circulated through it. In embodiments, this may be achieved by precisely controlling the geomechanical stress between injector and producer wells and thus enabling the reliable creation of flow conduits of known and predetermined dimensions between them.

2. Certain Specific Embodiments

Now, certain specific embodiments are described, which are by no means an exclusive description of the inventions. Other specific embodiments, including those referenced in the drawings, are encompassed by this application and any patent that issues therefrom.

One or more specific embodiments disclosed herein includes a method of controlling tensile-split conduits in a subterranean geothermal formation, comprising the following steps: providing an injection well extending from a surface to a subterranean geothermal formation, wherein the injection well comprises a plurality of cemented casing sleeves, wherein each of the plurality of cemented casing sleeves is capable of being opened, closed, or choked; providing a production well extending from the surface to the subterranean geothermal formation, wherein the production well comprises an uncemented liner, wherein the uncemented liner comprises a slotted/predrilled liner; configuring the injection well for injection of a tensile-splitting fluid into a production zone, wherein the production zone is defined within the subterranean geothermal formation, and further wherein the production zone requires tensile-splitting to enhance fluid conductivity; configuring the production well to produce a heated fluid from the production zone; applying pressure to the production well at a pressure below the tensile-splitting initiation point, wherein the shear stress is increased in the maximum horizontal stress direction and a tensile-splitting conduit is encouraged to intersect the production well; creating a plurality of tensile-split conduits by injecting the tensile-splitting fluid into the production zone of the injection well, and further wherein each of the plurality of tensile-split conduits intersects the production well; raising or lowering the pressure in the production well in response to acquired real-time data during the tensile-splitting operation, wherein the raising or lowering of the pressure in the production well facilitates changing the height, width, and/or length parameters of the induced plurality of tensile-splitting conduits, and further wherein the pressure is raised in the production well by pumping a pressure fluid into the production well while simultaneously pumping the pressure fluid into the injection well, and further wherein the pressure is lowered in the production well by lowering the hydrostatic level by employing a pump, jetting, or flowing, and further wherein the real-time data comprises pressure, temperature, seismic information, or a combination thereof, wherein the real-time data is input into a computer equipped with artificial intelligence; establishing fluid communication between the injection well and the production well by imposing a hydraulic pressure above the hydro-shear pressure and below the tensile-splitting pressure on the plurality of tensile-split conduits, wherein the plurality of tensile-split conduits are maintained in an open condition, in order to extract heat by circulating a supercritical carbon dioxide between the injection well and the production well; and producing the heated fluid to the surface, wherein the heated fluid is employed as direct heat, for electricity generation, or for creating energy carrier fluids.

In any one of the methods or systems described herein, each of the plurality of tensile-split conduits may be created simultaneously.

In any one of the methods or systems described herein, fluid communication between the injection well and the production well may be improved by employing a mined or man-made proppant.

In any one of the methods or systems described herein, operations may be halted and pressures bled when the mined or man-made proppant is detected in the production well.

In any one of the methods or systems described herein, the production well may comprise a tubular string.

In any one of the methods or systems described herein, the method may further comprise circulating a circulating fluid, wherein the circulating fluid removes the mined or man-made proppant.

In any one of the methods or systems described herein, fluid communication between the injection well and the production well may be improved by employing an expandable electrophilic acid-gas-reactive fracturing and recovery fluid.

In any one of the methods or systems described herein, a mechanical device may be employed in the production well, wherein a rock near the production well is weakened in the direction of the injection well.

In any one of the methods or systems described herein, the step of establishing fluid communication between the production well and the injection well may employ a cooled fluid, wherein the cooled fluid causes the subterranean geological formation to fracture from the thermal shock effect.

In any one of the methods or systems described herein, the method may further comprise creating an energy storage reservoir by injecting an injection fluid to increase the pressure of the plurality of tensile-splitting conduits, wherein the depressurizing of the injection fluid provides energy to generate electricity or to distribute direct heat.

In any one of the methods or systems described herein, an artificial intelligence system may be utilized to optimize the well layout, stimulation, rate of heat extraction, heat exchanger selection and design, power generation equipment selection and design to economically optimize heat extraction from the reservoir.

In any one of the methods or systems described herein, perforations may be employed within the injection well as an alternative to the plurality of cemented casing sleeves.

3. Specific Embodiments in the Figures

The drawings presented herein are for illustrative purposes only and are not intended to limit the scope of the claims. Rather, the drawings are intended to help enable one having ordinary skill in the art to make and use the claimed inventions.

In the drawings and descriptions that follow, like parts are typically marked throughout the specification and drawings with the same reference numerals. The drawn figures are not necessarily to scale. Certain features of the embodiments may be presented exaggerated in scale or in somewhat schematic form, and some details of conventional elements may be excluded in the interest of clarity and conciseness. The present invention may be implemented in embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between these elements and may also include indirect interaction between these elements.

Unless otherwise specified, use of the terms "up," "upper," "upward," "uphole," "upstream," or other like terms shall be construed as generally toward the surface of the formation and of shallower depth below exposed earth. Likewise, use of the terms "down," "lower," "downward," "downhole," or other like terms shall be construed as generally toward the bottom, terminal end of a well, regardless of the well orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Unless otherwise specified, use of the terms "tensile-splitting," "hydro-shearing," "soft hydraulic simulation," "hydraulic fracturing," and "conduit creation" refer to cracking, splitting, opening, or reopening the rock and extending the created crack in three dimensions. Whereas "tensile-splitting" typically refers to the initial splitting of the rock and "hydro-shearing" typically refers to reopening and or extending existing fissures or fractures or splits in the rock.

Unless otherwise specified, use of the terms "conduit," "created conduits," "flow channel," and "crack" refer to the void in the rock between the rock's faces.

Unless otherwise specified, "the heel" is the start of the horizontal (or inclined) production/injection interval, and "the toe" is the far end of it.

Unless otherwise specified, the terms "producer," "producer well," "production well," and "production wellbore" are used synonymously in this patent. Further, unless otherwise specified, the terms "injector," "injector well," "injection well," and "injection wellbore" are used synonymously in this patent.

Unless otherwise specified, the term "casing" is a steel tubing of a particular diameter that is inserted into a well to, e.g., shore up the hole and/or to isolate a particular rock interval. The casing may be cemented to the rock and/or to a larger casing through which it has been inserted, or a void may be left between them. Unless otherwise specified, the term "liner" is a casing that does not extend back to the surface.

Tensile-splitting a deep hot impermeable formation to create new conduits between wells to flow fluids and capture heat is relatively new. The fracturing of shales and hydrocarbon reservoirs is fairly well understood, but with the emphasis of stimulating production in the well whilst avoiding frac hits with other wells at all costs.

However, for geothermal applications it is most desirable for flow channels to connect wells. To achieve the optimum flow connection between wells, the tensile-splitting parameters must be controlled in both the well where fluid is being injected and any other wells where there is a desire for the conduit to intersect and/or to establish fluid communication with.

It has long been understood what controls the parameters of height, width, and length in tensile-split and hydro-sheared channels and conduits. Part of the tool kit to change these parameters is the type of stimulation fluid and its characteristics such as its viscosity, density, flow rate and compressibility. Likewise, how pressure applied to rock affects and changes a rock's maximum and minimum stresses is well understood.

In EGS methods, the (near)-parallel horizontal wells may be from 50 feet apart to more than 1,000 feet apart, with the wider separation accessing a larger area from which to draw heat. However, depending on rock stress in granite type formations, "wing lengths" (i.e., the length of a conduit created from one well towards another) of greater than 350 feet may be difficult to reliably obtain using current technology, but the disclosure herein foresees no absolute upper limit to that distance.

The wells may be vertical or inclined rather than horizontal. The lengths of the production (or injection) intervals through which fluids flow to/from the rock range from 50 feet to more than 15,000 feet, with 3,000 feet to 5,000 feet commonplace.

Injectors and producers are typically nearly parallel, but it is not required to maintain an exact distance between them, and deviations of over 50 feet do not materially affect calculated performance. Furthermore, deviations from parallel are sometimes intended to help stabilize the flood front of water advancing through the many conduits from the injector(s) to the producer(s) as explained below.

Tensile-splitting and hydro-shearing conduits may have heights of many hundreds, or even thousands of feet, and this allows latitude in the well placements.

In the production/injection interval, casing diameters of 4½ inch to 9⅝ inch are typical, but larger sizes are possible. Selection of casing size is influenced by balancing the higher cost of larger sizes against the lower friction of the circulating fluid at the flowrate required to recover the desired thermal power. For example, in reservoirs at 350° F. it may be desirable to have 5½" or 7" casing sizes to reduce circulation friction when pumping 20 barrels per minute ("BPM"-a barrel is 42 U.S. gallons or 5.615 cubic feet) between wells 5,000 feet long and 350 feet apart containing 20 to 100 tensile-split conduits to recover enough heat to generate 5 $MW_e$ of net electrical power.

It is desirable to equalize the fluid flow injected into each tensile-split-enhanced and hydro-shear-enhanced conduit from the injector to create a stable flood front moving toward the producer(s). This reduces the bypassing of areas of hot rock. The challenge increases with the length of the injection interval and the number of conduits. At high circulation rates the pressure at the heel of the well will be materially higher than at the toe and will therefore force more fluid to enter the conduits near the heel than the toe. Sleeves, like those made by NCS Multistage, may be open, closed, or choked. These types of sleeves facilitate the initial creation of multiple conduits and then permit the conduits to be closed or choked to maintain a stable flood front. A supporting technique is to deviate the injector and producer(s) from parallel so that the "toes" of the two wells are nearer than the "heels". This helps control the stability of the flood front since the injection pressure decreases through flow friction from heel to toe and the production pressure reduces through flow friction from toe to heel.

Stimulation fluids may be recovered from the producer and reused, resulting in less use of chemicals and water.

Knowledge of how to effect rock stresses during stimulation operation in wells is discussed in U.S. Pat. No. 10,801,307, but those efforts have been focused on how to space conduits so they will not come in contact, and only with operations performed in one well at a time rather than simultaneously.

Computer-generated heat models may be used (e.g., TOUGH2, DARTS, Waiwera, GeoDT, ResFrac and Geophires) to calculate the optimum lateral lengths, distances apart, flow conduits, and circulation rates for a specific geologic temperature and thermal heat capacity of the formation.

The embodiments disclosed herein relate to developing conventional oil field fracturing and tensile-splitting methods further, thereby providing a method to optimize the placement of the tensile-split and hydro-sheared conduits to ensure contact and communication with another well and a conduit with sufficient permeability (permeability is a measure of the ability of fluids to flow through rocks and conduits) to circulate fluids without undue friction losses.

Knowing if and when the tensile-split-created conduits come into contact with the target well allows optimization of the stimulation treatment. Chemicals and proppants used in the treatment, as well as equipment hire, are expensive. Knowing when to stop the treatment is a major contributor to optimizing its cost-effectiveness.

Placement of the tensile-split conduit can be optimized by coupling the actions undertaken in the injector and in the producer, as well as leveraging the sensory information collected from the wells.

FIG. 1A depicts an exemplary operating environment where many different geothermal reservoir development methods are depicted including the Enhanced Geothermal System 100. FIG. 1A shows two different formations. One formation is sedimentary rock formation 105 formed of rock such as clay, sandstone, limestones, carbonates, etc. The other formation is igneous and metamorphic rock formation 110 formed of marble, basalt, granite, etc. The Earth's material is constantly exposed to erosion and weathering, and the resulting accumulated loose particles eventually settle and form sedimentary rock. Igneous rocks are formed when magma (or molten rocks) cool down and become solid. Metamorphic rocks are the result of the transformation of other rocks. Rocks that are subjected to intense heat and pressure change their original shape and form, and become metamorphic rocks.

Generally, a formation is a rock unit that is distinctive enough in appearance that a geologic mapper can tell it apart from the surrounding rock layers. Sedimentary rock formations typically have significantly higher permeability than igneous and metamorphic rocks. Permeability in igneous and metamorphic formations is generally through fractures. Depths of formations may range from a surface 115 increasing to a depth very much greater than 16,000 feet below the surface 115.

As shown in FIG. 1A, as formation depths increase, temperatures may also increase. For example, FIG. 1A shows a level 120, a level 125, and a level 130, wherein the temperatures are 300°, 400°, and 500° Fahrenheit, respectively. Also shown are horizontal wells 135, 140, 145, 150, and 155 and vertical wells 160, 165, 170, 175, 180, and 185. Conventional geothermal developments 190 are shown in sedimentary rock formation 105 and flow between the laterals of horizontal wells 140 and 145 is accomplished by pumping through permeable formations. Closed loop developments 195 are typically found in deeper, hotter igneous formations, and heat is extracted by circulating fluid in a single well, such as horizontal well 135. Home heating developments 200 are typically accomplished by circulating in a closed loop in very shallow sedimentary rocks. Carbon sequestration projects 205 typically involve storing gases like $CO_2$ in sedimentary rocks. Conventional geothermal projects 190 may also involve circulating fluids or flowing fluids from deep underground formations in shallow fractured or highly permeable formations. Enhanced geothermal systems 100 involve circulating fluids between long laterals of horizontal wells in hot igneous rocks. Circulation is accomplished by creating permeable conduits between the laterals of horizontal injector and producer wells in minimally fractured impermeable igneous rock formations.

Figure 1B:
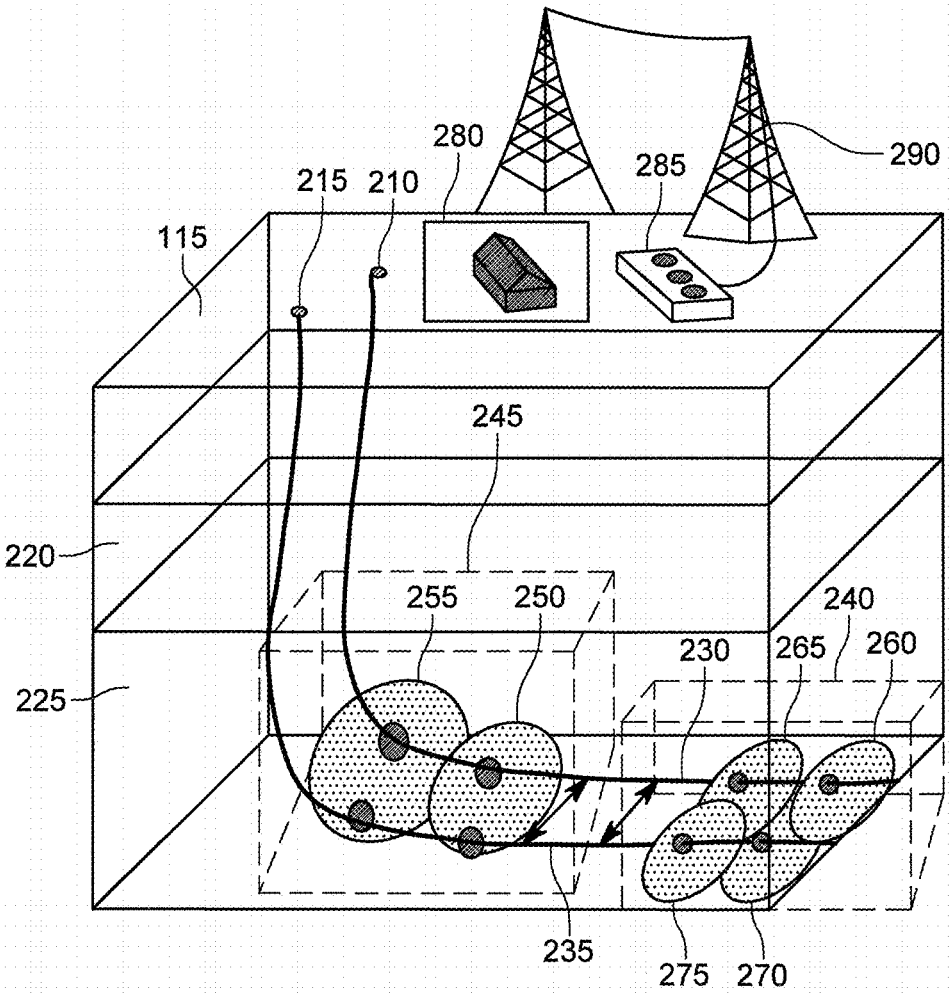
FIG. 1B is an illustration of an embodiment of an enhanced geothermal system.

FIG. 1B depicts an exemplary operating environment of an embodiment of the methods, systems, and apparatuses disclosed herein. Unless otherwise stated, the horizontal, vertical, or deviated nature of any figure is not to be construed as limiting the well to any particular configuration. As depicted, in embodiments the operating environment may suitably describe a well 210 and a well 215 that have been drilled by a conventional drilling rig or other means. In embodiments, wells 210 and 215 may emanate from the surface 115 and intersect a geologic sedimentary formation like sandstone formation 220 before passing through a geothermal formation like granite formation 225 (or a marble or basalt formation) forming a lateral 230 and a lateral 235, respectively. In embodiments, laterals 230 and 235 may be parallel, perpendicular, or obtuse to one another. In embodiments, laterals 230 and 235 may be vertical, deviated, horizontal, curved, or porpoise up and down in a specified window. In embodiments, a typical window may be 50 feet up and 50 feet sideways but may be smaller or greater as required to meet heat production requirements and drilling parameters. In embodiments, laterals 230 and 235 may be separated by 350 feet as depicted by the two solid arrows in FIG. 1B. However, in embodiments separation distances potentially much greater than 350 feet or less than 350 feet may be performed. In embodiments, a window may also be used to set acceptable separation distance between laterals 230 and 235. For example, the window may be 350 feet plus or minus 20 feet. In embodiments, other distances may be used depending on heat modeling to determine the optimum distance for a project life.

In embodiments, the graphical representations are presented to explain the enhanced geothermal, potential well configurations, and completion methods. In embodiments, well 210 may comprise a producer well, and well 215 may comprise an injector well. In other embodiments, well 210 may comprise an injector well, and well 215 may comprise a producer well. In embodiments, wells 210 and 215 may have parallel horizontal laterals 230 and 235, respectfully. In other embodiments, such wells may have non-parallel horizontal laterals. In the embodiment of FIG. 1B, well 210 is an injector well, and well 215 is a producer well. In embodiments, in between wells 210 and 215 is shown heat reservoirs 240 and 245, which are part of the granite formation 225. Generally, heat reservoirs are a subset of a main reservoir. In embodiments, induced tensile-split conduits, discussed below, are shown emanating from one or both of wells 210 and 215, creating an altered zone in between wells 210 and 215 and on each side of the laterals 230 and 235.

In embodiments, heat reservoir 245 may convey the DCM completion process. In embodiments, well 210 may be intended to be an injector well and have tensile-split conduits 250 and 255 emanating at lateral 230 and growing to intersect lateral 235, which may be intended to be a producer well. In FIG. 1B, only two tensile-split conduits 250 and 255 are illustrated, but in embodiments several hundred tensile-split conduits may be employed. In embodiments, the distance between the emanation points of tensile-split conducts 250 and 255 may be 350 feet, but greater or lesser distances may exist depending on information from the heat modeling and rock stress affected area. In the embodiment shown in FIG. 1B, well 210 may be cased and cemented at least across granite formation 225. In embodiments, emanation points may be from holes or created holes in shear sleeves like those described by SPE paper 210210-MS entitled "Development of Multi-Stage Fracturing System and Wellbore Tractor to Enable Zonal Isolation During Stimulation and EGS Operations in Horizontal Wellbores." In other embodiments, conventional explosive or jetted perforations may be employed. In alternative embodiments, a single tensile-split conduit may be created emanating from lateral 230 and additional tensile-split conduit may also be created emanating from lateral 235. In embodiments, conventional limited entry (LE) perforating and treatment methods like those described by K. W. Lagrone in his 1960 paper entitled "Better Completion by Controlled Fracture Placement Limited-Entry Technique" may be employed wherein two or more tensile-split or hydro-shear conduits may be created simultaneously.

In another alternative embodiment, heat reservoir 240, noted in the cross-hatched lines, describes the FEN completion process. In embodiments, well 210 may comprise an injector well and comprise tensile-split conduits 260 and 265 emanating from lateral 230. In embodiments, tensile-split conduits 260 and 265 may or may not intersect lateral 235.

In embodiments, well 215 may comprise a producer well and also be either open hole (bare foot) or be cased and cemented and have tensile-split conduits 270 and 275 emanating from lateral 235. Similarly, in embodiments, open hole methods using packers and sleeves may be employed. In embodiments, the tensile-split conduits 270 and 275 may or may not intersect lateral 230. In embodiments, hydro-shearing of in-situ micro cracks in the rock comprising granite formation 225 may also enable communication between the tensile-split conduits 270 and 260, as well as between the conduits 275 and 265.

In embodiments, in either the DCM (depicted in heat reservoir 240) or FEN (depicted in heat reservoir 245) process completion described above, a pumping facility 280 and a generator facility 285 would not be limited to only two wells 210 and 215. In embodiments, a plurality of wells may be employed, wherein the plurality of wells may be horizontal, vertical, deviated or a combination thereof. While the operating environment depicted in FIG. 1B refers to wells 210 and 215 penetrating the Earth's surface on dry land, it should be understood that one or more of the methods, systems, and apparatuses illustrated herein may alternatively be employed in other operating environments, such as within offshore wells where at least a portion of one or both wells is beneath a body of water. In embodiments, FIG. 1B may refer to wells 210 and 215, wherein each well 210 and 215 comprises sections in granite formation 225. In embodiments, granite formation 225 may comprise heat reservoirs 240 and 245 denoting completion methods conventional and DCM, respectively. In embodiments, the following may be found on the surface: a pumping facility 280, a generator facility 285, and electrical transmission lines 290. In embodiments, cool fluid may be injected down well 210 across granite formation 225 picking up heat before returning to the pumping facility 280 through well 215. In embodiments, heat may be extracted from the fluid circulated between wells 210 and 215 in the generator facility 285, and electricity may be sent to the electrical grid through transmission lines 290. In embodiments, heat may be extracted from the fluid circulated between wells 210 and 215 with no generator facility 285 but instead a heat exchanger giving up heat to another fluid supplying direct heat or steam to another party.

Figure 2A:
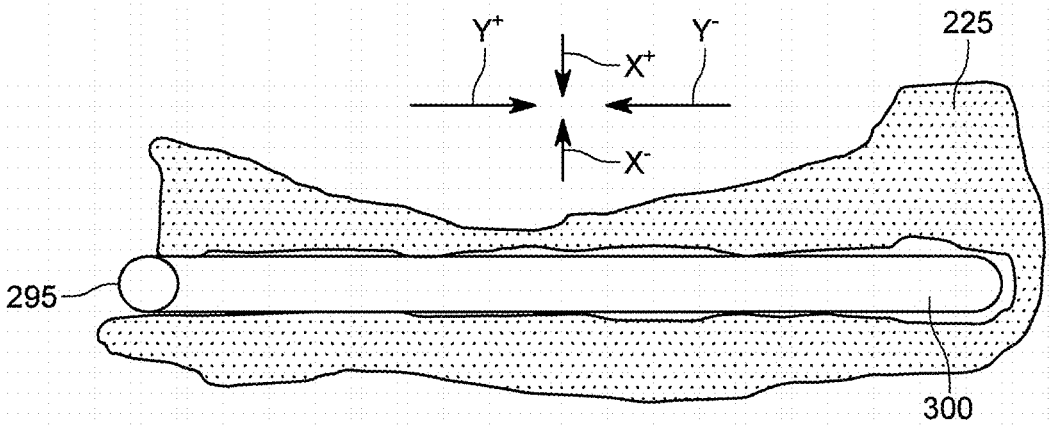
FIG. 2A illustrates an embodiment of an enhanced geothermal system wherein a horizontal plane extends through a subterranean formation as well as horizontally-acting forces along an x-axis and along a y-axis.
Figure 2B:
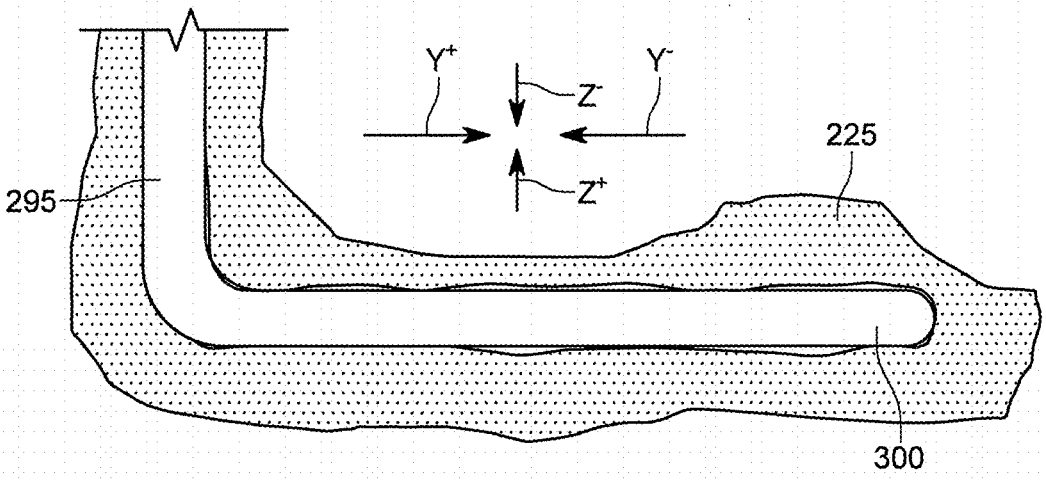
FIG. 2B illustrates an embodiment of an enhanced geothermal system wherein a vertical plane extends through a subterranean formation as well as horizontally-acting forces along the y-axis and vertically-acting forces along the z-axis.

Stresses of varying magnitudes and orientations may be present within a geothermal-heat-containing subterranean formation. Although the stresses present may be complex and numerous, they may be effectively simplified to three principal stresses. FIGS. 2A and 2B illustrate the various forces acting at a given point within a subterranean formation. FIG. 2A illustrates a horizontal plane extending through the subterranean granite formation 225 (i.e., a top view as if looking down a well) and horizontally acting forces along an x-axis and along a y-axis. In FIG. 2A, vertically acting forces along a z-axis would extend in a direction perpendicular to this plane. Similarly, FIG. 2B illustrates a vertical plane extending through the subterranean granite formation 225 (i.e., a side view of a well) and horizontally acting forces along the y-axis and vertically-acting forces along the z-axis. In FIG. 2B, horizontally acting forces along an x-axis would extend in a direction perpendicular to this plane.

As shown in FIGS. 2A and 2B, the forces may be simplified to two horizontally acting forces (i.e., the x-axis and the y-axis) and one vertically-acting force (i.e., the z-axis).

FIGS. 2A and 2B describe the standard force directions a well may be exposed to in the subterranean granite formation 225. FIG. 2A depicts a vertical section 295 from the top view, which also shows a horizontal lateral 300 in the x/y plane. FIG. 2B shows vertical section 295 down the x-axis or side view depicting the orientation of the y/z plane.

In embodiments, it may be assumed that the stress acting along the z-axis is approximately equal to the weight of the formation above (e.g., toward the surface) a given location in the subterranean granite formation 225. With respect to the stresses acting along the horizontal axes, cumulatively referred to as the horizontal stress field, for example in FIG. 2A the x-axis and the y-axis, one of these principal stresses may naturally be of a greater magnitude than the other. As used herein, the "maximum horizontal stress" or $\sigma_{HMax}$ refers to the orientation of the principal horizontal stress having the greatest magnitude, and the "minimum horizontal stress" or $\sigma_{HMin}$ refers to the orientation of the principal horizontal stress having the least magnitude. As will be appreciated by one of skill in the art, a $\sigma_{HMax}$ may be perpendicular to the $\sigma_{HMin}$. Unless otherwise specified, as used herein "stress anisotropy" refers to the difference in magnitude between the $\sigma_{HMax}$ and $\sigma_{HMin}$.

Figure 3:
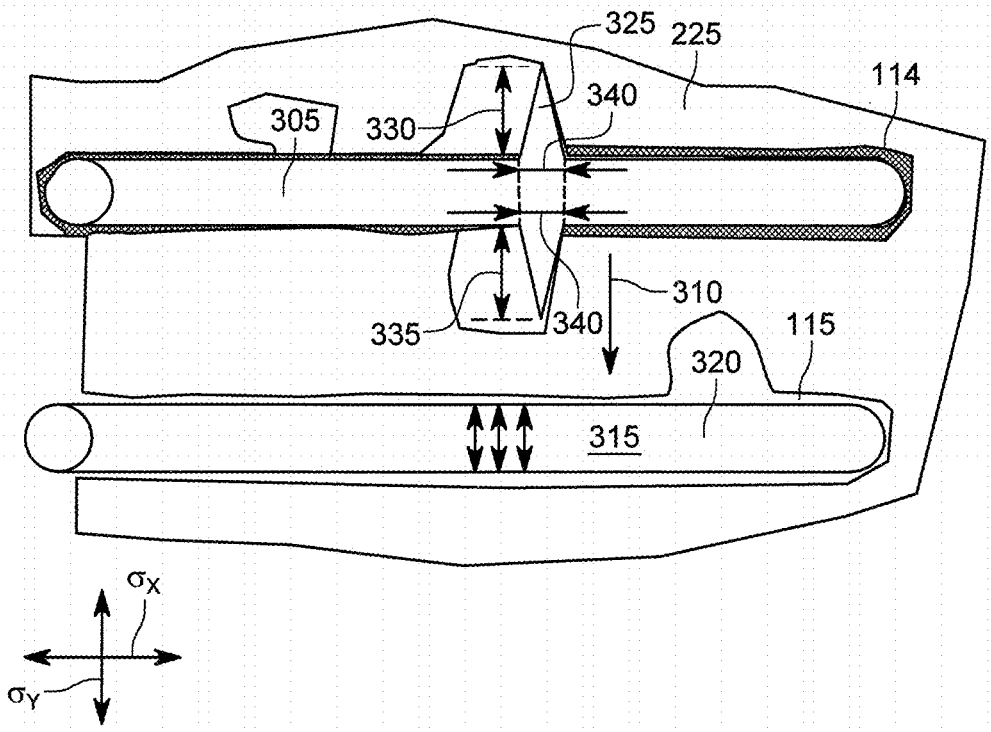
FIG. 3 illustrates an embodiment of a method suitably employed to improve the ability to intersect another geothermal well by altering stress anisotropy of a subterranean formation.

FIG. 3 illustrates graphically an embodiment of a method suitably employed to improve the ability to intersect another geothermal well by altering stress anisotropy of a subterranean formation. In embodiments, during the tensile-splitting or hydro-shearing operation in a cased and cemented wellbore lateral 305 shown by a fracture direction 310, hydraulic pressure is applied (shown by the arrows 315) in an open hole or uncemented wellbore 320 to encourage a degree of change in the stress anisotropy to tensile-split the formation 225 to create an approximately circular flow conduit 325 emanating from lateral 305 to intersect uncemented wellbore 320 in a predictable way. In embodiments, conduit wings 330 and 335 represent in planar view the half circles of the flow conduit 325 either side of lateral 305. These half circle conduits are sometimes referred to "conduit wings" or "wings". In embodiments, flow conduit 325 in the x/y plane comprises a conduit aperture width 340 ("aperture") and the lengths of its conduit wings 330 and 335. In embodiments, although the length and shape of conduit wings 330 and 335 may be shown to be identical, they may be very similar or of totally different lengths and widths dependent on near-well formation stresses. In embodiments, together conduit wings 330 and 335 may be referred to singularly as the conduit 325. Likewise, in embodiments aperture 340 may not be constant but may vary along the conduit wings 330 and 335 and along a height 345 (not shown).

Figure 4A:
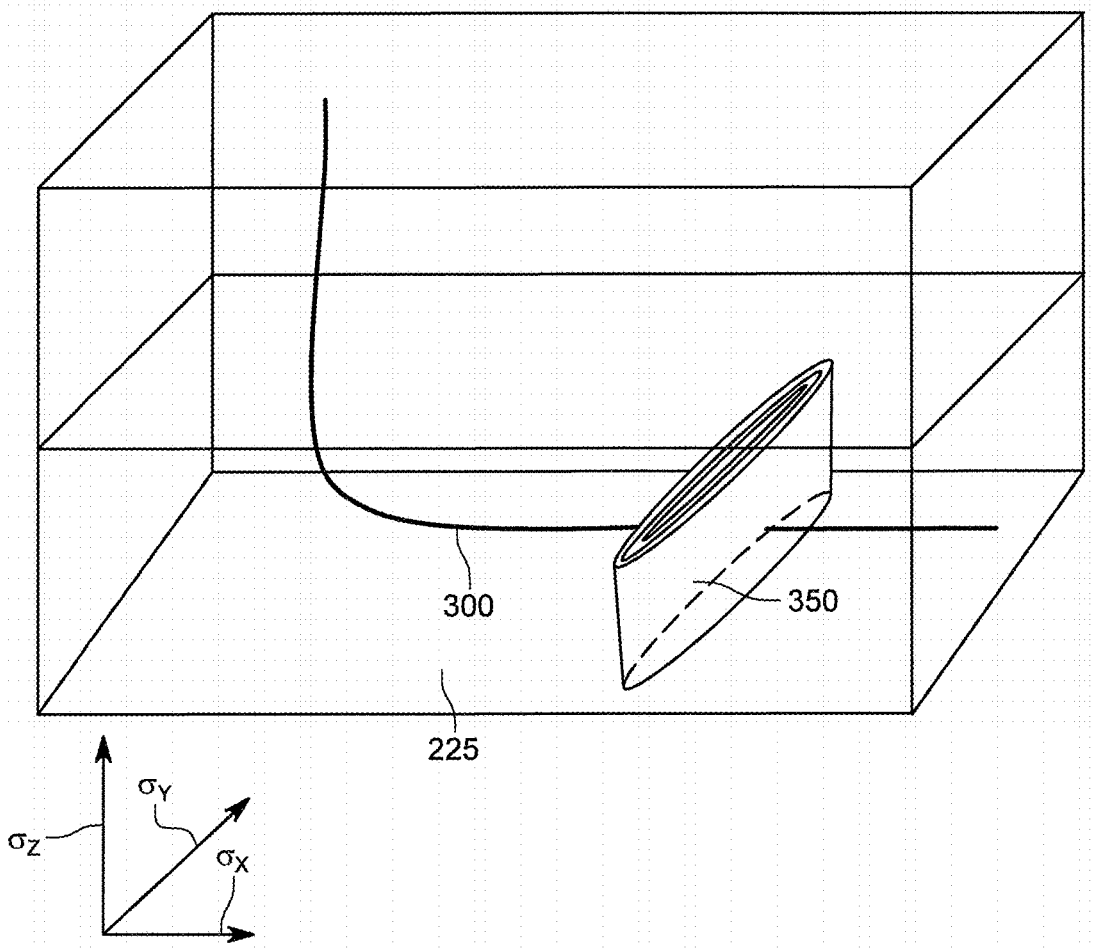
FIG. 4A illustrates an embodiment of an enhanced geothermal system wherein a horizontal plane extends through a subterranean formation.
Figure 4B:
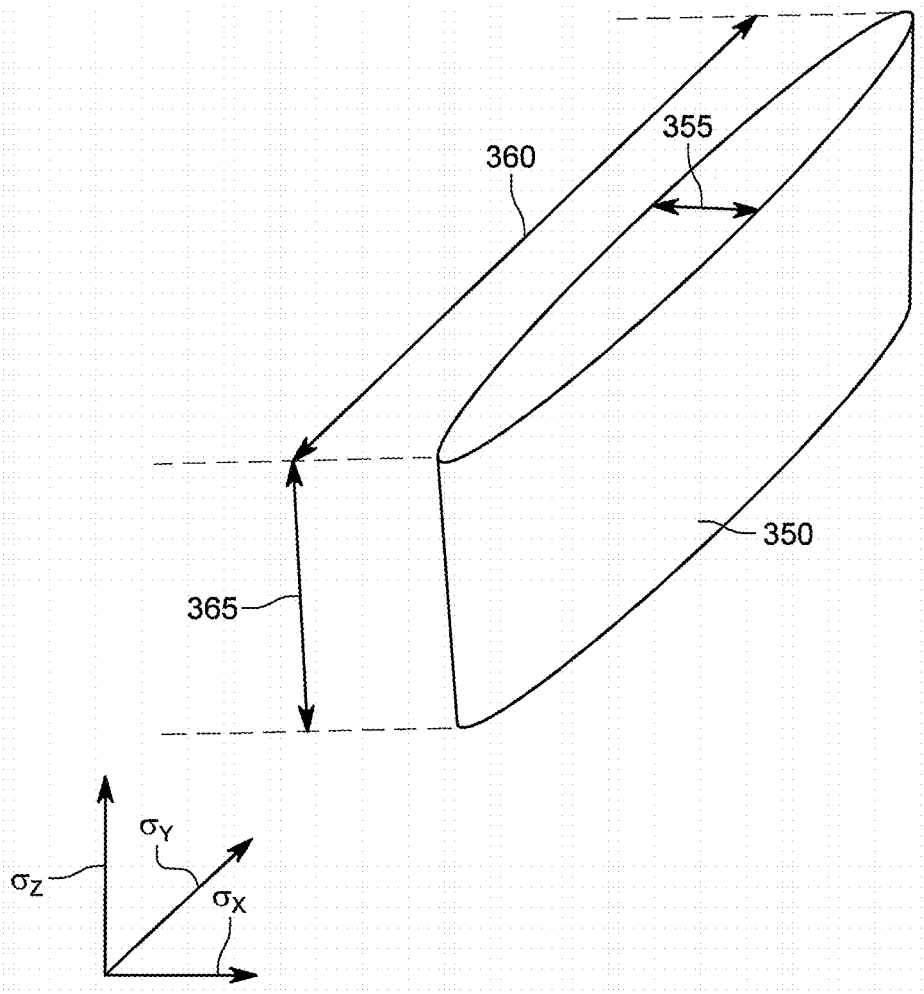
FIG. 4B illustrates an embodiment wherein a conduit may tend to form such that the conduit width may be approximately parallel to the $\sigma_{HMin}$; and the conduit length may be approximately parallel to the $\sigma_{HMax}$.

Referring to FIG. 4A, a horizontal plane extending through the subterranean granite formation 225 is illustrated. In embodiments, lateral 300 may extend through the subterranean granite formation 225. In embodiments, lines $\sigma_X$ and $\sigma_Y$ represent the net major and minor principal horizontal stresses present within the subterranean granite formation 225. In embodiments, a tensile-split conduit 350 is shown forming in the subterranean granite formation 225. In the embodiment of FIG. 4A, $\sigma_X$ represents the $\sigma_{HMin}$, and Oy represents the ØHMax (note that the length of lines $\sigma_Y$ and $\sigma_X$ corresponds to the magnitude of the stress along these axes; the length of line $\sigma_Y$ is greater than the length of line σx, indicating that the magnitude of the stress is greater along the line $\sigma_Y$). As illustrated in FIG. 4A, because less resistance is applied against the subterranean granite formation 225 along line ox (e.g., the $\sigma_{HMin}$), the tensile-split conduit 350 may form such that the subterranean granite formation 225 is forced apart in a direction perpendicular to line $\sigma_X$. In an expanded view depicted in FIG. 4B, the tensile-split conduit 350 may tend to form such that the conduit aperture width 355 (i.e., the distance between the faces of the tensile-split conduit 350) may be approximately parallel to the $\sigma_{HMin}$; and a conduit length 360 may be approximately parallel to the $\sigma_{HMax}$. In embodiments, a conduit height 365 may increase as the conduit propagates along the z-axis.

Figure 5A:
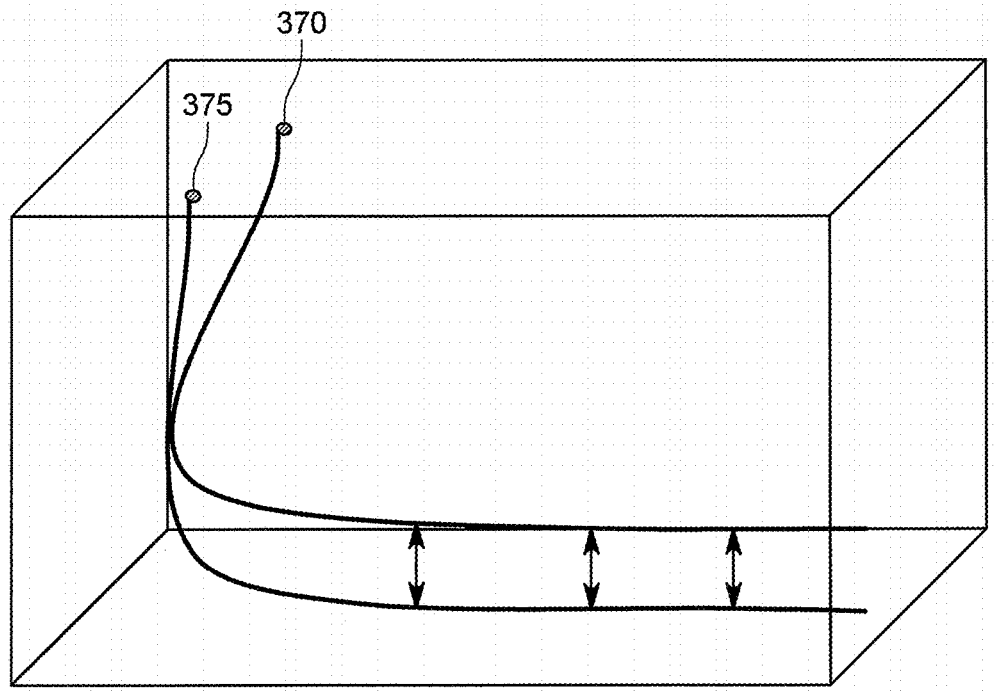
FIG. 5A illustrates an embodiment comprising a first well and a second well, wherein both wells are shown in a horizontal lateral layout with the first well above the second well.
Figure 5B:
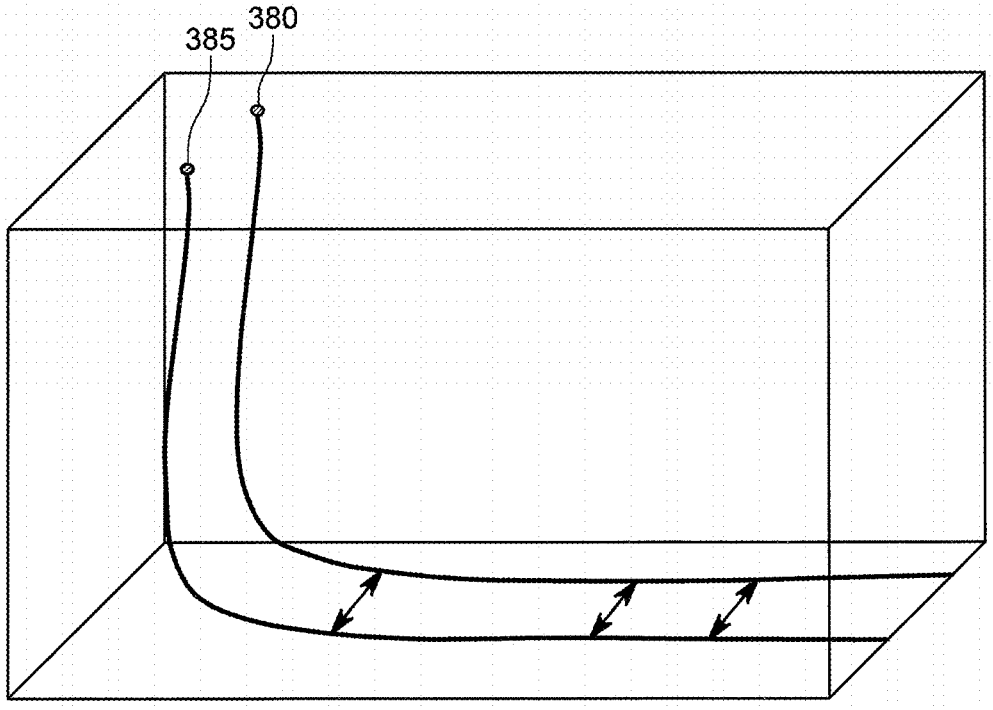
FIG. 5B illustrates an embodiment comprising a first well and a second well, wherein both wells are shown in a horizontal lateral layout with the wells parallel to each other.
Figure 5C:
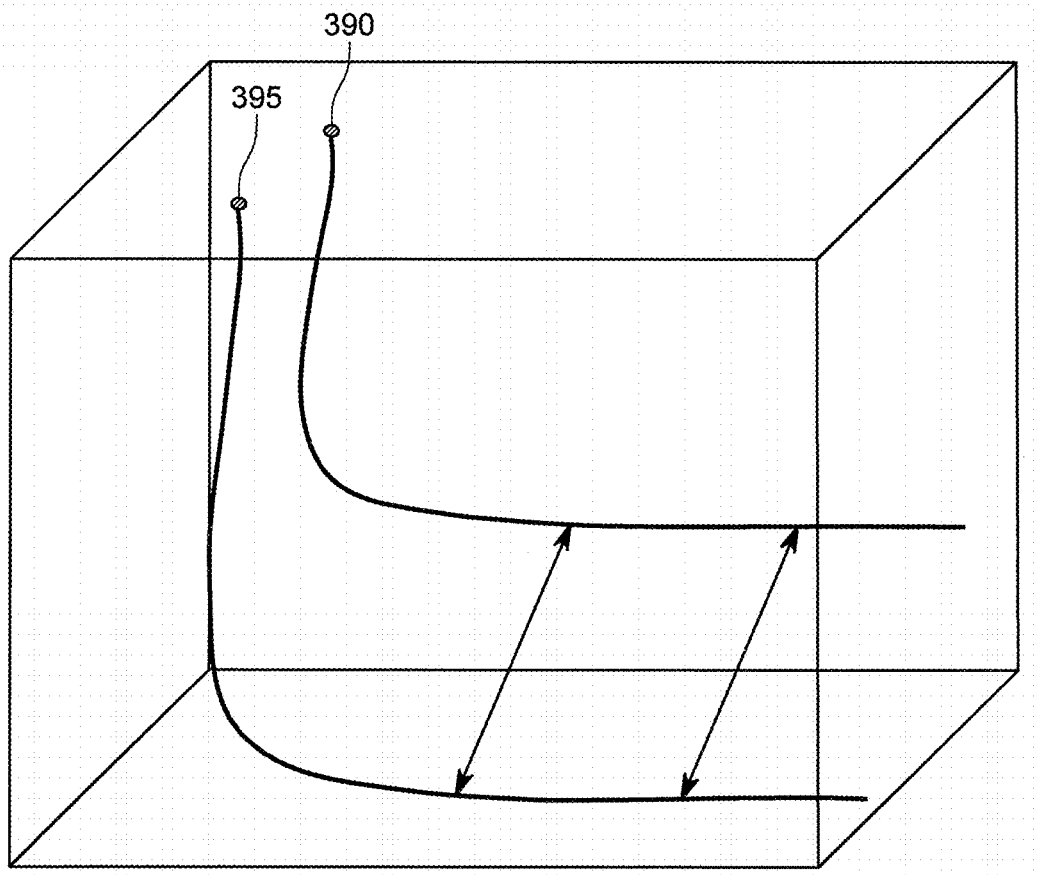
FIG. 5C illustrates an embodiment comprising a first well and a second well, wherein the wells are shown in a horizontal lateral layout with the first well obtuse to the second well.

In embodiments, wells used to extract heat from subterranean formations may be vertical, deviated, horizontal, or a combination of these. FIG. 5A illustrates an embodiment comprising a well 370 and a well 375, wherein wells 370 and 375 are shown in a horizontal lateral layout with well 370 above well 375. FIG. 5B illustrates an embodiment comprising a well 380 and a well 385, wherein wells 380 and 385 are shown in a horizontal lateral layout with wells 380 and 385 parallel to each other. FIG. 5C illustrates an embodiment comprising a well 390 and a well 395, wherein wells 390 and 395 are shown in a horizontal lateral layout with wells 390 and 395 obtuse to each other. Thus, FIGS. 5A, 5B, and 5C illustrate three different possible horizontal lateral layouts: above, parallel, and obtuse, respectively. In embodiments, wells may be used in one of these three fashions, a combination of them, or any other layout where there are two opposing wells in a subterranean formation, whether parallel in any axis or none.

Figure 6A:
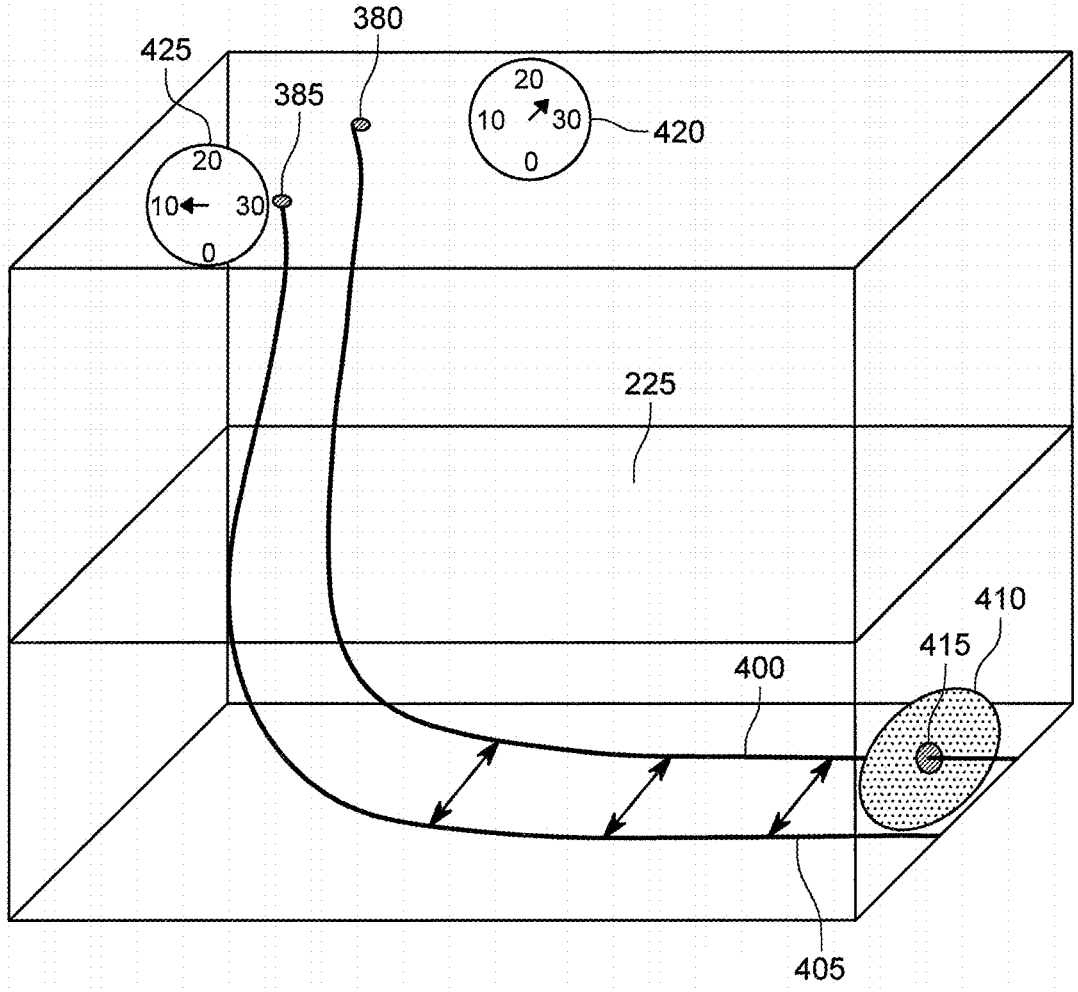
FIG. 6A illustrates two wells in a subterranean formation.
Figure 6B:
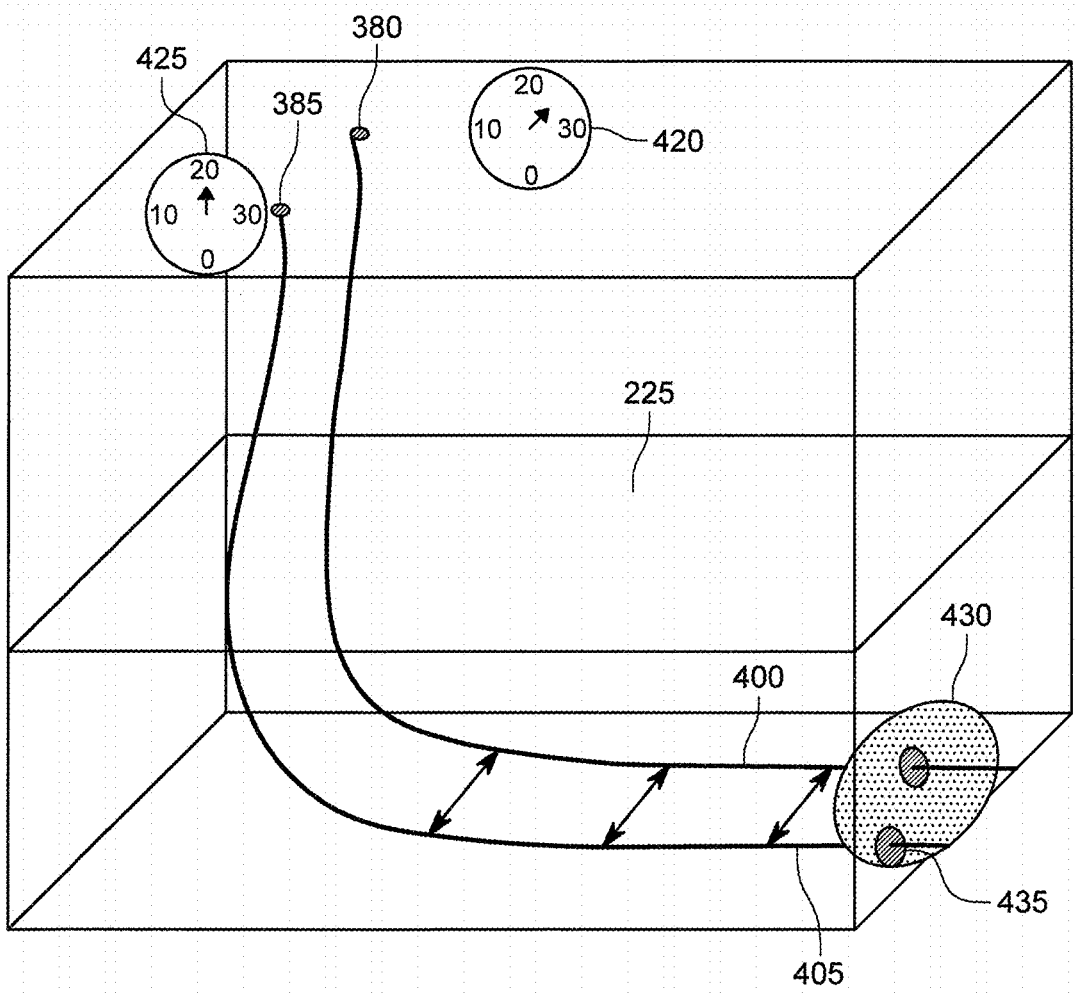
FIG. 6B illustrates a pressure response in a second well, as shown on a pressure gauge, when a tensile-split conduit intersects the second well at a specific point.

FIGS. 6A and 6B show graphical representations of the DCM. FIG. 6A depicts wells 380 and 385 in subterranean granite formation 225. In embodiments, well 380 may be an injector well comprising a lateral 400, which is cased and cemented. In embodiments, well 385 may be a producer well comprising a lateral 405 in the heat reservoir of granite formation 225, which may comprise an uncemented liner, open hole, or barefoot. In embodiments, a tensile-split conduit 410 may be initiated from lateral 400 at a point 415. In embodiments, to encourage the tensile-split conduit 410 to expand towards lateral 405, hydraulic pressure may be applied to stress the granite formation 225 in well 385. In embodiments, the tensile-split conduit initiation hydraulic pressure may be seen on a pressure gauge 420, which may represent hydraulic pressure. Hydraulic pressure may be defined as "continuous physical force exerted on or against an object by something in contact with it." Pressure for this purpose may be created hydraulically by compressing fluids like water or supercritical $CO_2$ for well 380. In embodiments, the applied pressure may be seen on a pressure gauge 425, which may represent hydraulic pressure for well 385. In embodiments, the hydraulic pressure of well 385 may be slightly below a crack initiation point, i.e., the pressure value that is the maximum pressure before a new tensile-split initiation point (for example 7,000 psi). In embodiments, lower pressures may be applied, but the use of lower pressures (for example 5,000 psi) may result in less stress on the granite formation 225. Further, in embodiments if the granite formation 225 had previous contact with other conduits, it may be appropriate to pressure the granite formation 225 to a pressure lower than that required to reopen a conduit (the hydro-shear pressure). FIG. 6B shows the pressure response in well 385, as shown on pressure gauge 425, when a tensile-split conduit 430 intersects well 385 at point 435 (having moved from 10 to 20 on pressure gauge 425).

Figure 7A:
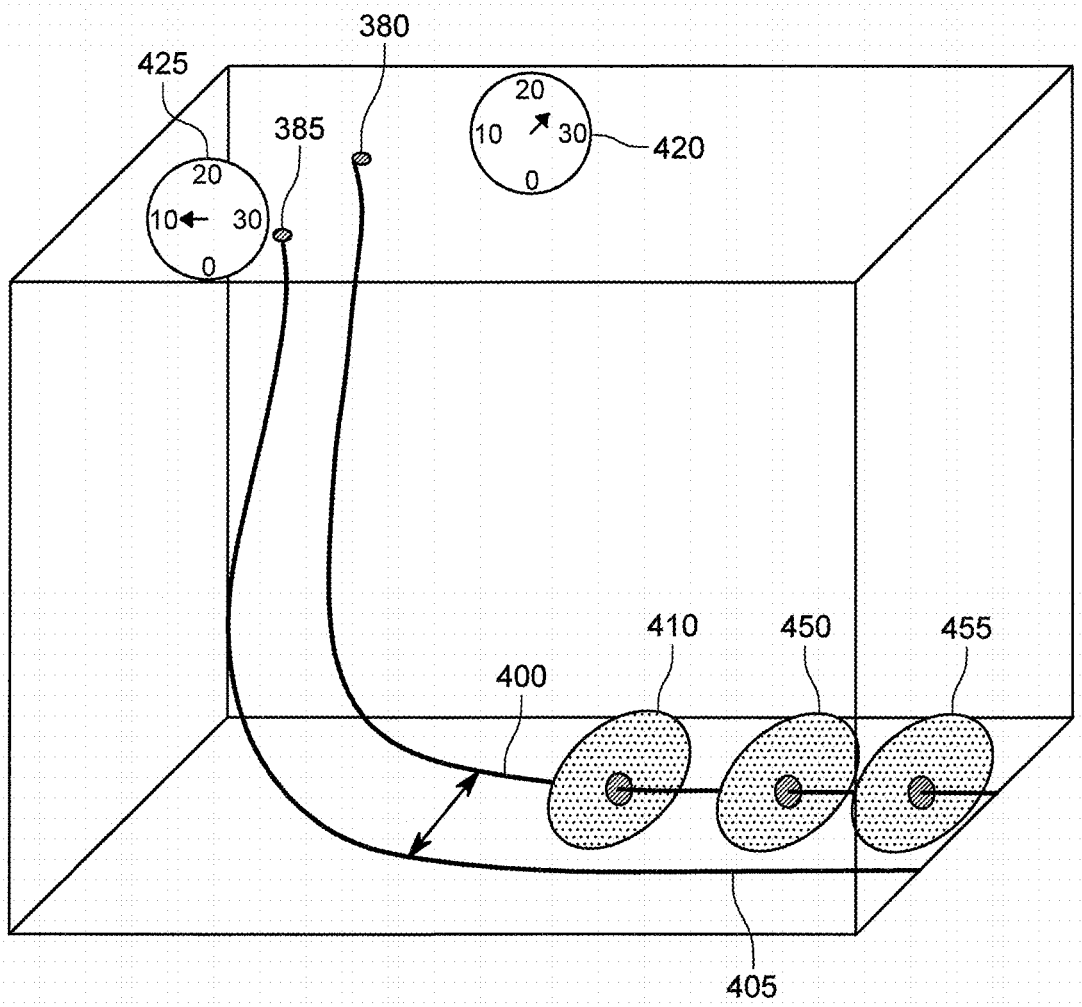
FIG. 7A illustrates an alternative embodiment to that shown in FIG. 6A wherein instead of one single tensile-split conduit, multiple tensile-split conduits are present.
Figure 7B:
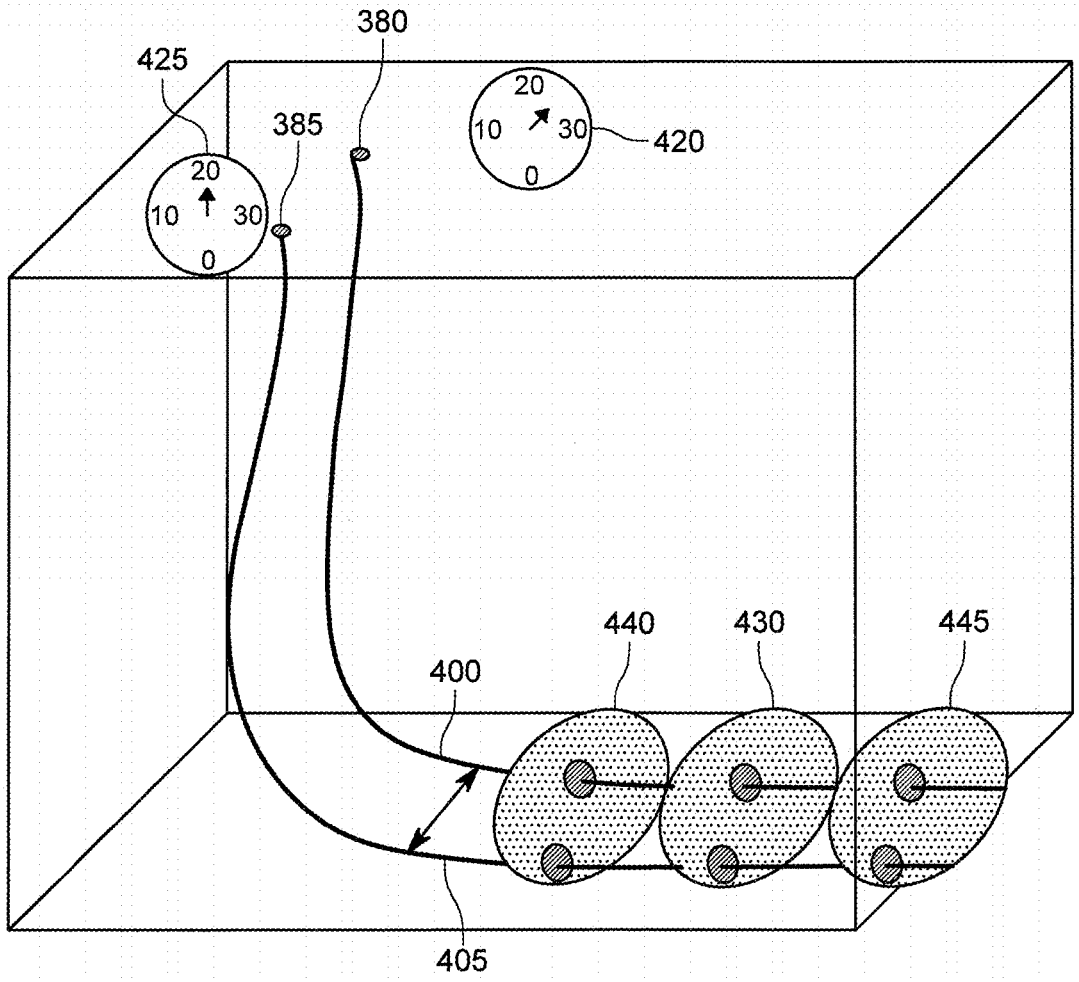
FIG. 7B illustrates an alternative embodiment to that shown in FIG. 6B wherein instead of one single tensile-split conduit, multiple tensile-split conduits are present.

FIGS. 7A and 7B are graphical representations of the embodiments shown in FIGS. 6A and 6B except instead of one single tensile-split conduit 430 as shown in FIG. 6B, the embodiment shown in FIG. 7B shows multiple tensile-split conduits. More specifically, FIG. 7B shows tensile-split conduits 440, 430, and 445. As was discussed previously, the plug and perf completion method creates multiple tensile-split conduits simultaneously. In embodiments, pressure may be applied in well 385 up to slightly below the initiation pressure of the tensile-split conduits 410, 450, and 455 from lateral 400 and before the conduits 410, 450, and 455 intersect the lateral 405 in well 385. In embodiments, the number of conduits to be put into communication between laterals 400 and 405 is not limited to three as illustrated in FIGS. 7A and 7B. Instead, the number of conduits may be determined by the "limited entry calculation" noted earlier by K. W. Lagrone in his 1960 SPE paper entitled "Better Completion by Controlled Fracture Placement Limited-Entry Technique," such that applying pressure to increase the stress in lateral 405 may be appropriate irrespective of how many conduits from lateral 400 were desired to come in contact with lateral 405. In embodiments, once one of the conduits 410, 450, or 455 comes in contact with lateral 405 (e.g., conduit 445), it may be appropriate to raise the pressure of lateral 405 to assist the opening of other tensile-split conduits from lateral 400 to come in communication with lateral 405 (e.g., conduits 440 and 430). Likewise, it may be desirable in embodiments to lower the pressure in lateral 405 from, for example, 7,000 psi to 4,000 psi by flowing the lateral 405 to encourage the tensile-split conduits 410, 450, and 455 to grow in the opposite direction, away from lateral 405.

Figure 8A:
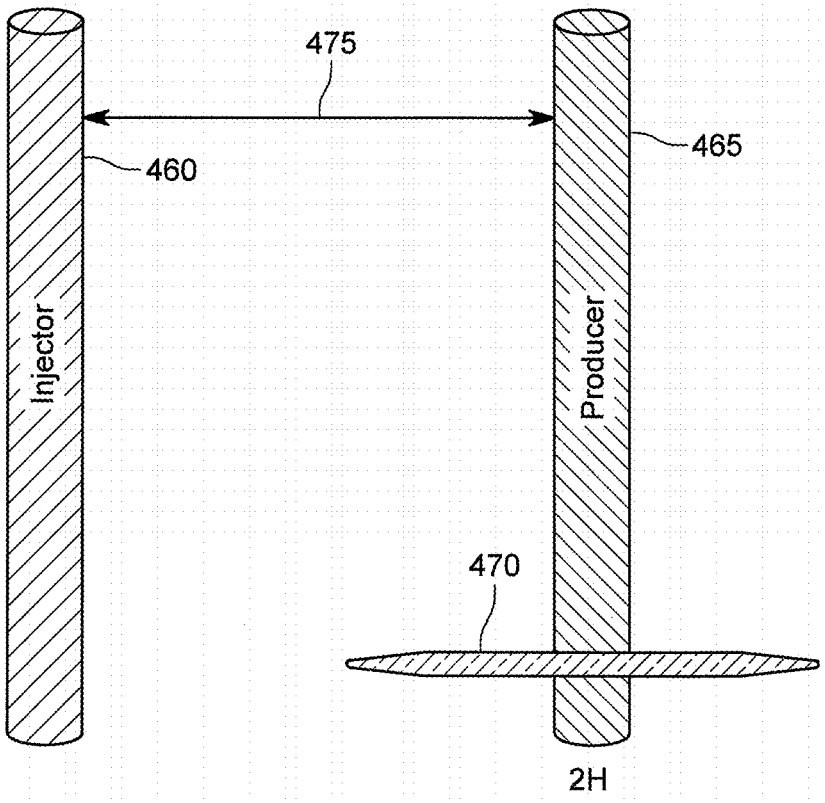
FIG. 8A illustrates a planar view of an embodiment comprising a first horizontal wellbore, which may be an injector, and a second horizontal wellbore, which may be a producer.
Figure 8B:
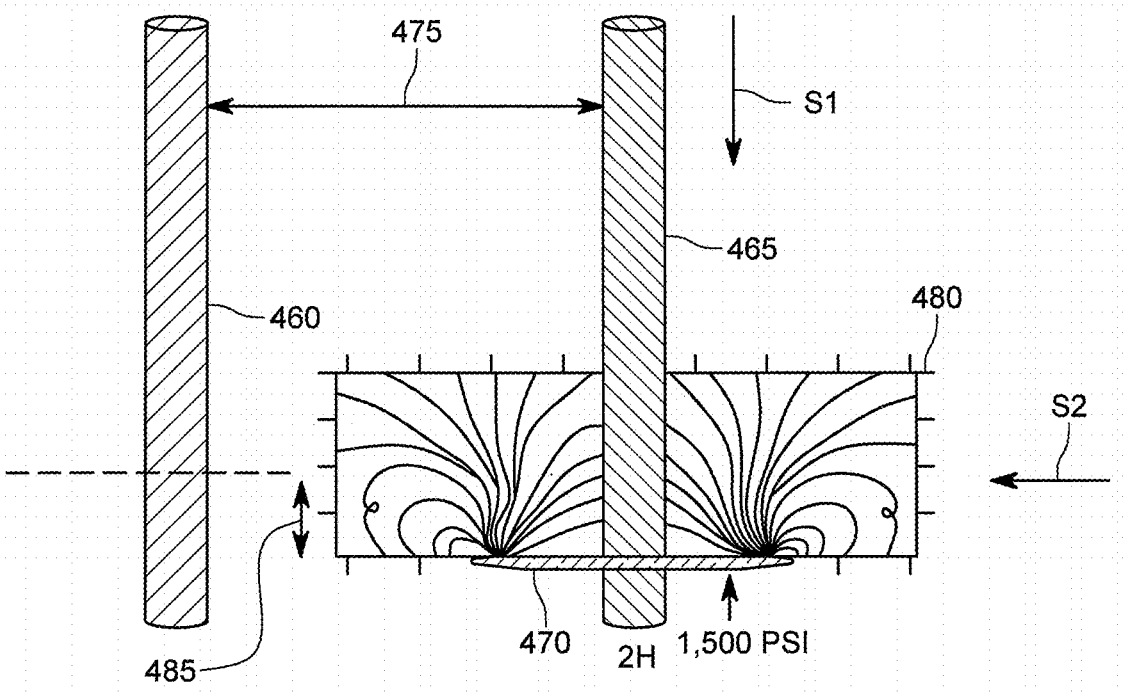
FIG. 8B illustrates an embodiment with a stress region, wherein there are isobaric lines, which decrease with distance from a newly created conduit.
Figure 8C:
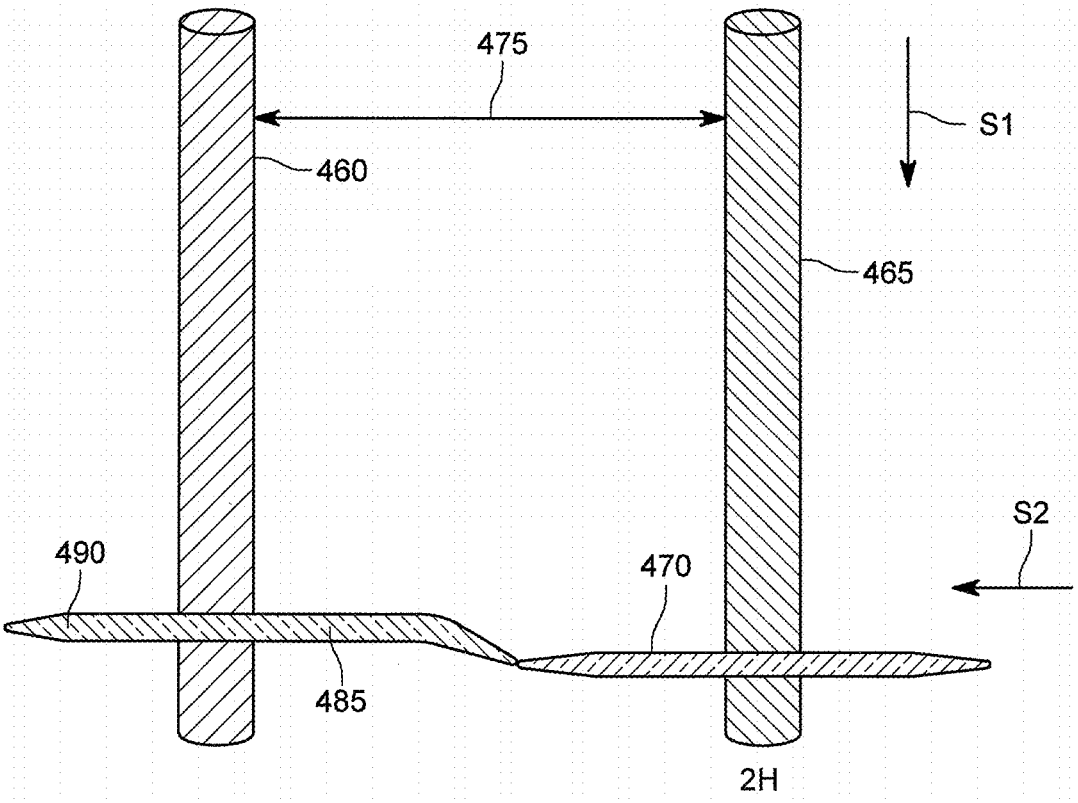
FIG. 8C illustrates an embodiment with a newly created conduit emanating from a wellbore.

FIGS. 8A, 8B, and 8C disclose an embodiment of a method ensuring that factures emanating from two separate parallel horizontal laterals will intersect and form a conduit whereby fluid may be passed between them. FIG. 8A shows a planar view of an embodiment comprising a horizontal lateral 460, which may be an injector, and a horizontal lateral 465, which may be a producer. It should be noted that this method would work even if lateral 460 were designated as the producer and lateral 465 were designated as the injector. In embodiments, a new conduit 470 may be created in the untreated, non-prestressed area between laterals 460 and 465. In embodiments, laterals 460 and 465 may be about 350 feet apart as noted by distance 475 (or very much more or less). FIG. 8B shows an embodiment with a stress region 480, wherein FIG. 8B shows isobaric lines starting at 1,500 psi, which decrease with distance from the newly created conduit 470. FIG. 8B also shows a distance 485, as noted by the arrow, which is the distance from the center of the aperture width of the newly created conduit 470 and a certain displacement along lateral 460. In embodiments, this distance 485 may be the maximum distance conduit 470 may spread from lateral 460 and still intersect conduit 470. FIG. 8C depicts an embodiment with a newly created conduit 490 emanating from lateral 460 at a level at distance 485 from the center of the aperture width of conduit 470. FIG. 8C depicts conduit 490 curving to intersect conduit 470 emanating from lateral 465.

Figure 9A:
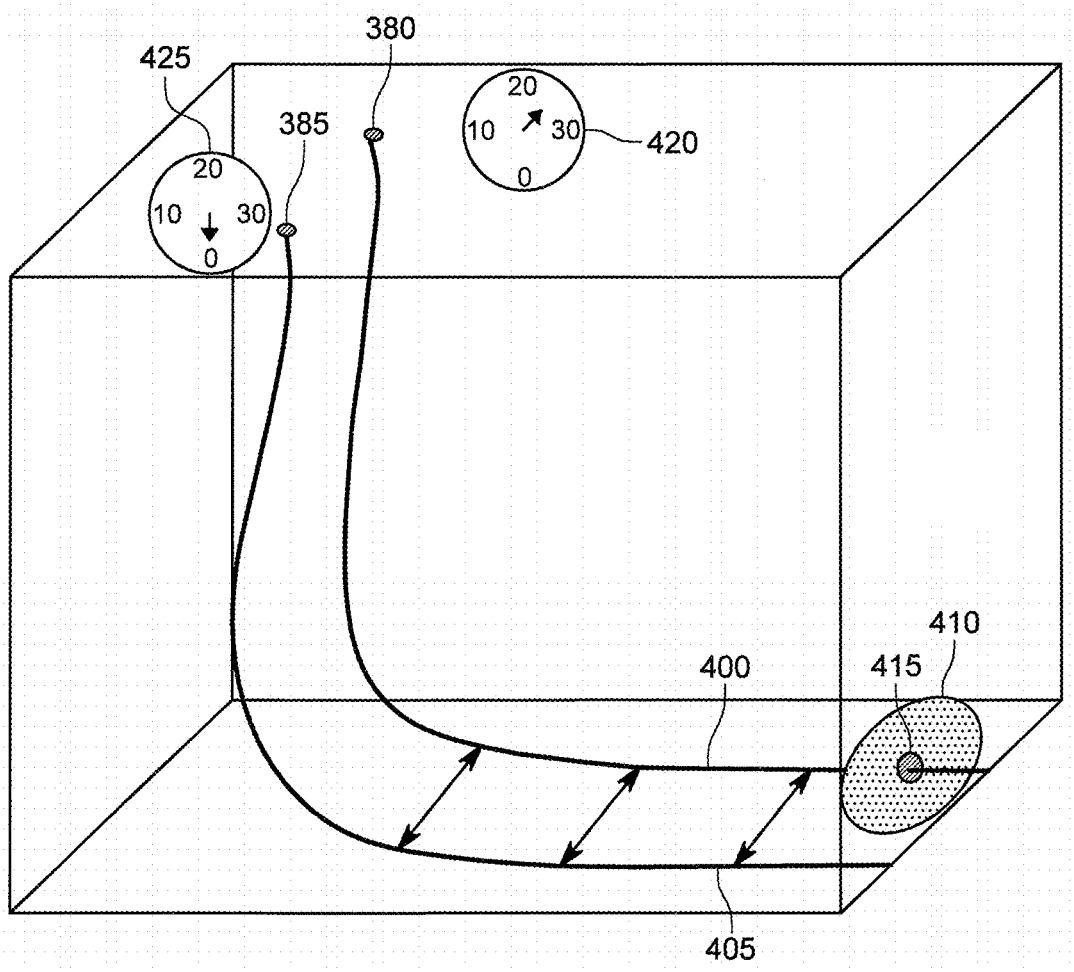
FIG. 9A illustrates an embodiment wherein a well may initiate a tensile-split conduit in an associated lateral.
Figure 9B:
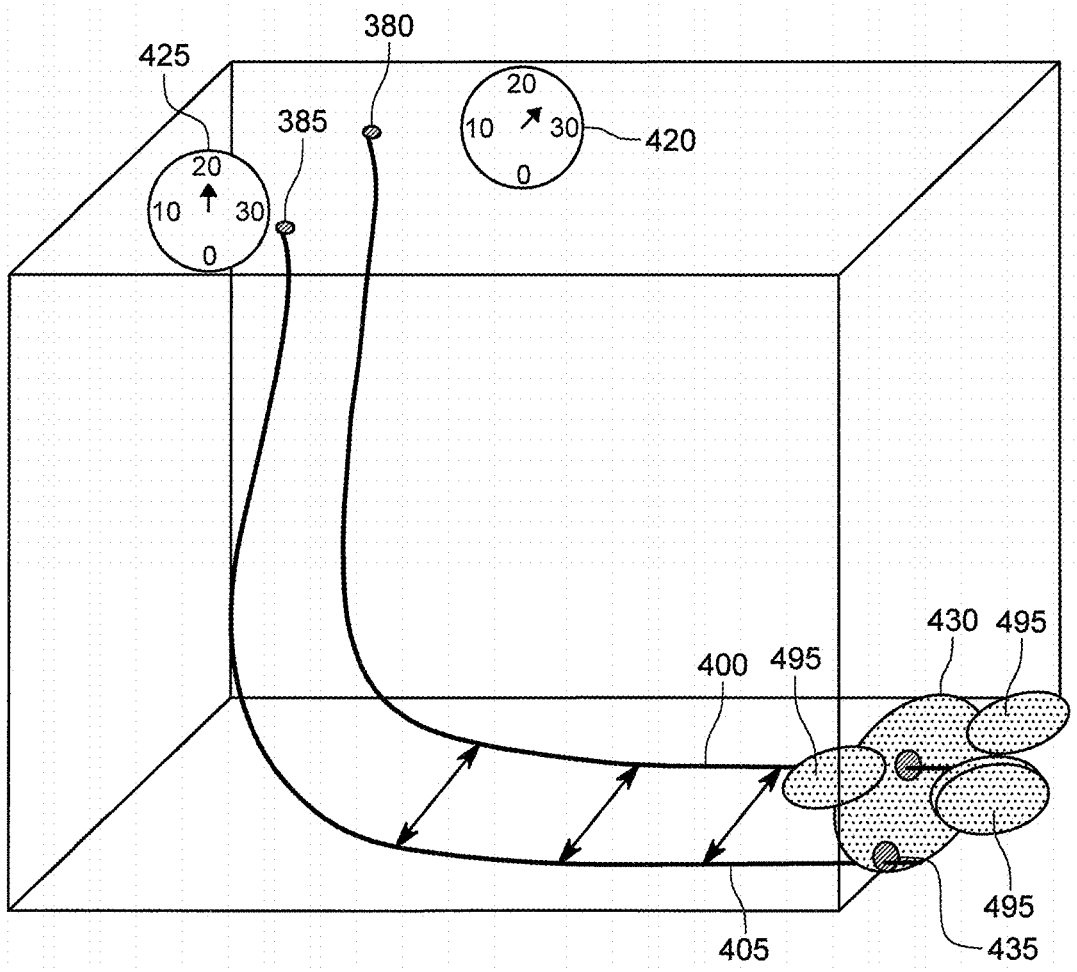
FIG. 9B illustrates an embodiment wherein additional pressure is applied to a well to create a tensile-split or to reactivate a plurality of conduits emanating from an original conduit.

FIGS. 9A and 9B disclose the ability to create, by tensile-splitting additional conduits off of the original conduit, and to reopen additional conduits by hydro-shearing. In embodiments, wells 380 and 385 are an injector/producer pair, respectively. Similar to the embodiments shown in FIG. 6A, in the embodiment shown in FIG. 9A, well 380 may initiate tensile-split conduit 410 in lateral 400 at point 415. In embodiments, the tensile-split conduit (or a pre-existing in-situ conduit) 410 may grow, but not yet intersect lateral 405 of well 385. FIG. 9B depicts applying additional pressure to well 380 to create a plurality of additional tensile-split conduits 495, which may be reactivated in-situ conduits emanating off conduit 430. (Conduit 430 has grown from conduit 410 in FIG. 9A to now intersect lateral 405). This can be seen in the value of gauge 425 changing from 0 in FIG. 9A to 20 in FIG. 9B. In embodiments, the tensile-split or in-situ conduits 495 may themselves intersect further conduits or natural cracks in the rock of the granite formation 225 to enable a more even and hence efficient distribution of heat extraction from the granite formation 225.

Figure 10A:
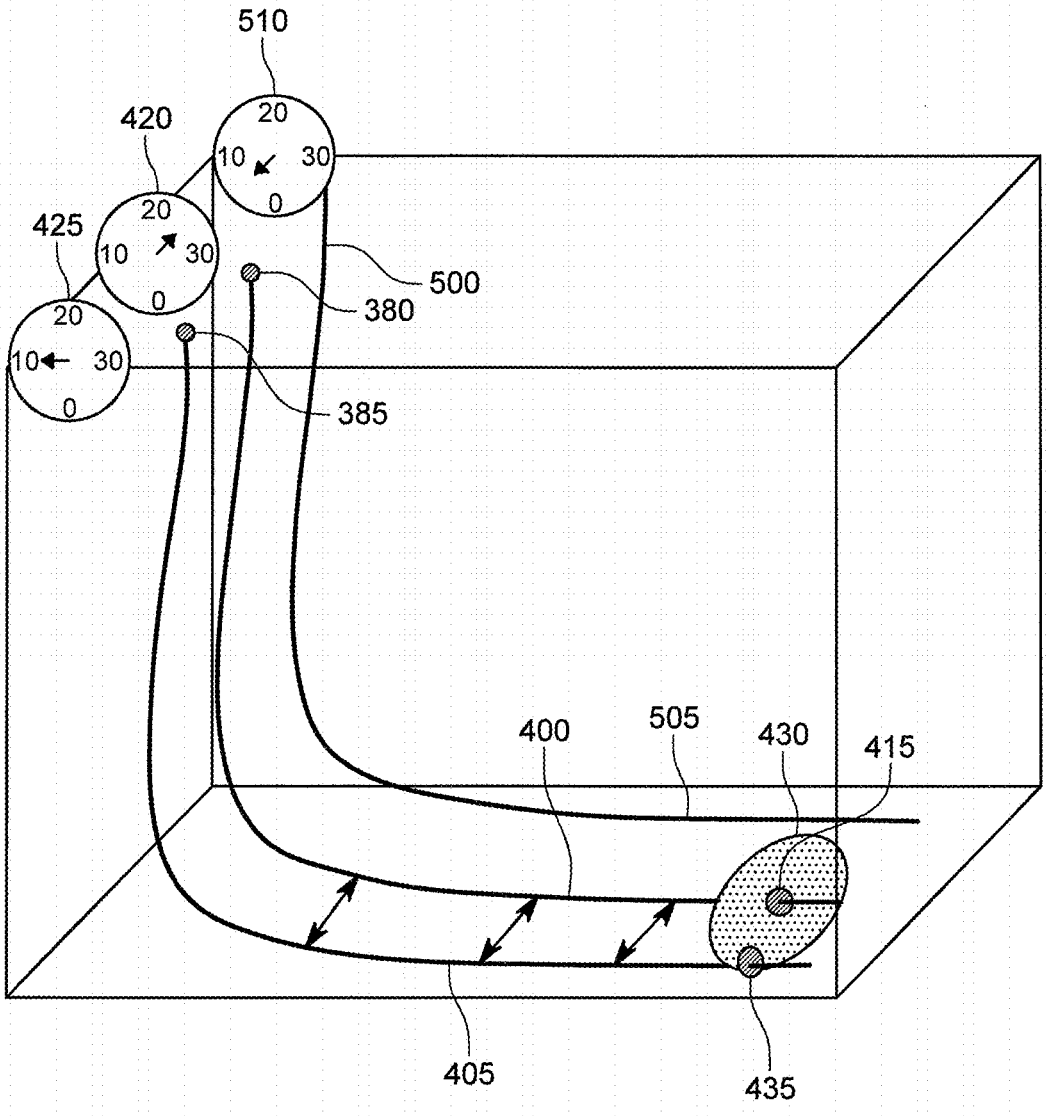
FIG. 10A illustrates an embodiment wherein a tensile-split conduit is initiated in a lateral at a specific point and the conduit grows until intersecting another lateral.
Figure 10B:
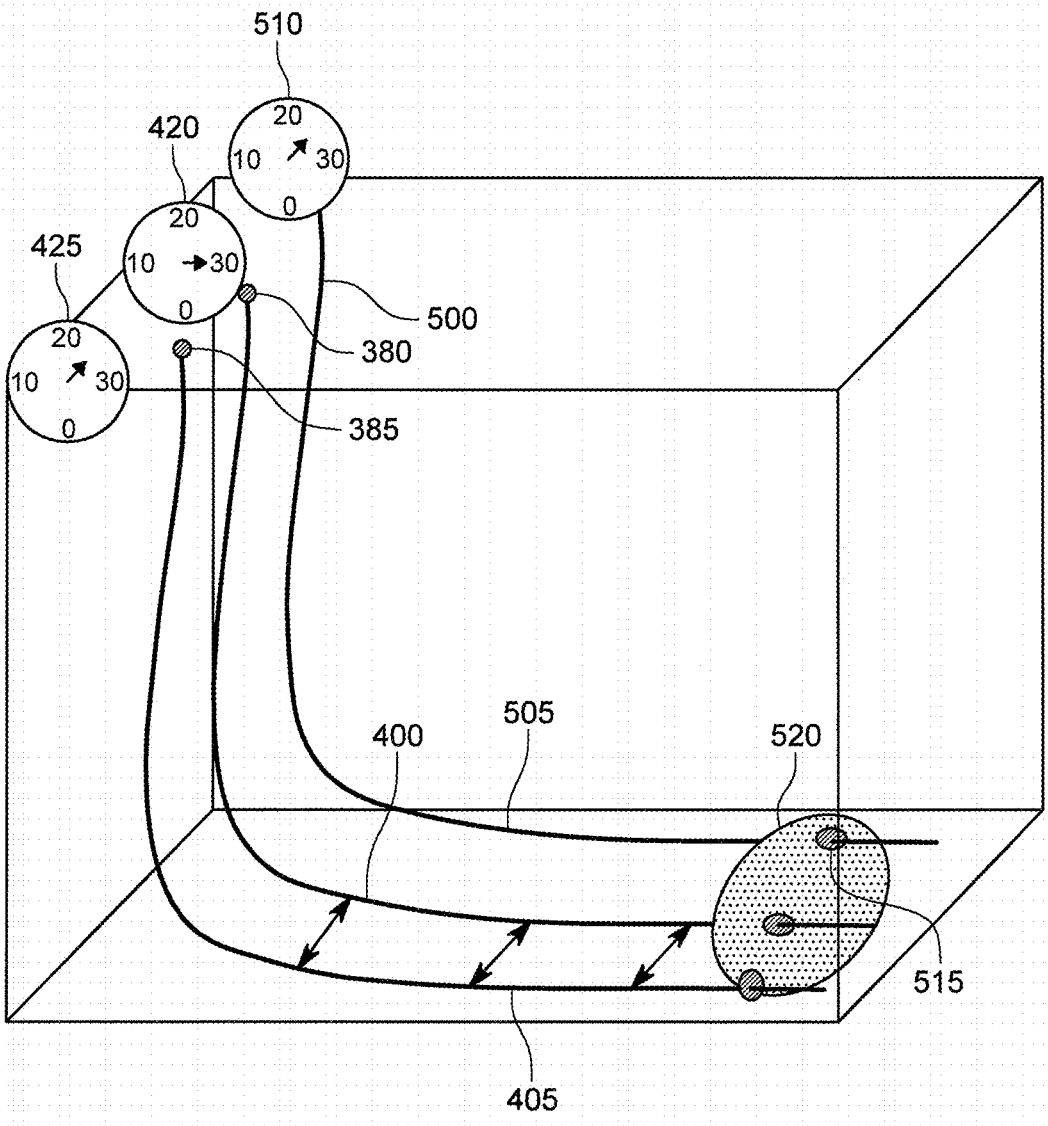
FIG. 10B illustrates an embodiment wherein increased pressure may be applied to encourage growth of a tensile-split conduit to grow in the direction of a specific lateral and contact that specific lateral at a specific point.

FIGS. 10A and 10B disclose the ability to affect the tensile-split conduit-wing growth in another direction along the same plane. In embodiments, well 380 may be an injector well with a cased and cemented lateral 400. In embodiments, well 385 and well 500, may be producer wells with uncemented lateral 405 and uncemented lateral 505, respectively. FIG. 10A discloses an embodiment initiating a tensile-split conduit in lateral 400 at point 415 and the conduit 430 growing until it intersects lateral 405 at a point 435 but not intersecting lateral 505. In embodiments, this may be seen in pressure gauges 425 and 420, as well as a pressure gauge 510, wherein the pressure reading for gauge 420 may be higher than the pressure reading for gauge 425, which may be higher than the pressure reading for gauge 510. In such embodiments, the pressures employed may range from typically 1,000 psi up to 10,000 psi, but the embodiment is not restricted to these values. FIG. 10B shows an embodiment wherein increased pressure as shown by pressure gauge 425 having increased from 10 in FIG. 10A to approximately 25 in FIG. 10B, and the hydraulic pressure may be applied to encourage tensile-split conduit 430 to grow in the direction of lateral 505 and contact lateral 505 at a point 515 to create a newly expanded conduit 520.

Figure 10C:
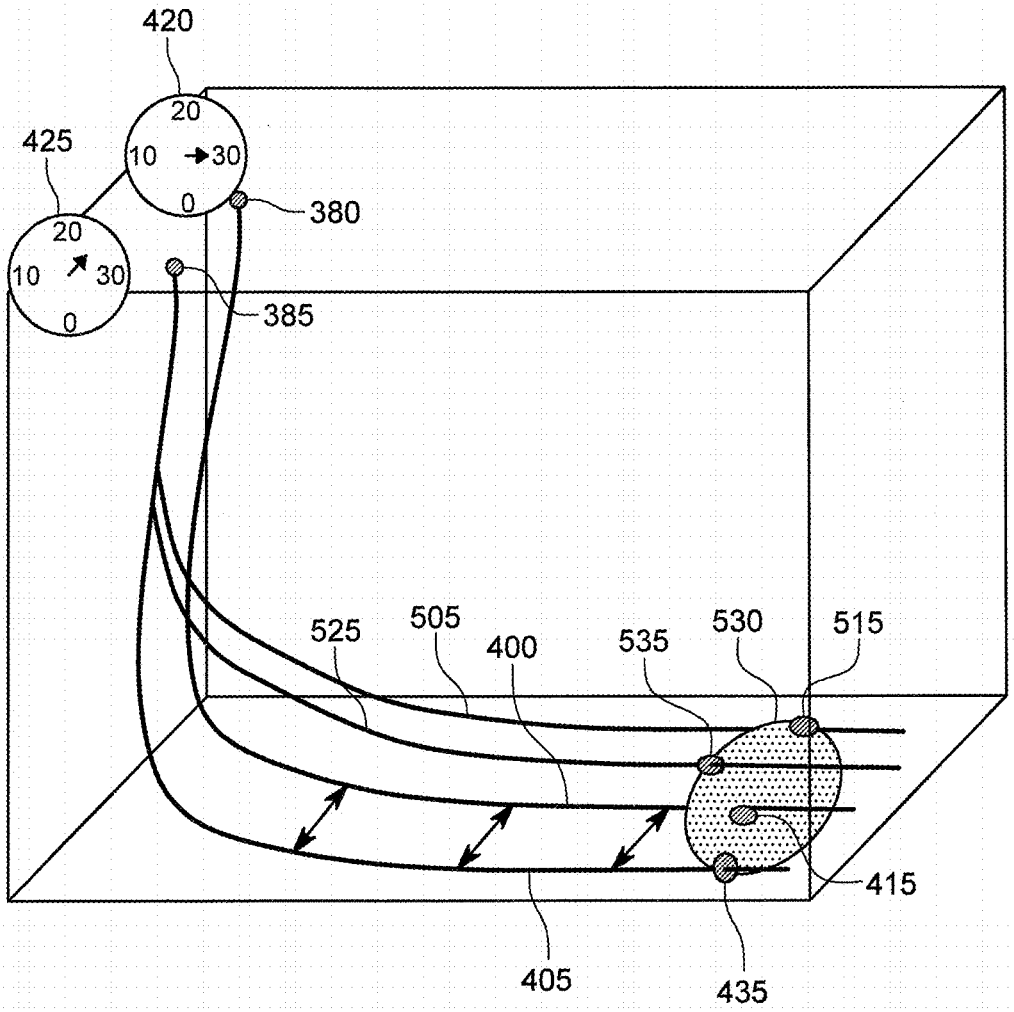
FIG. 10C illustrates a three-dimensional rendering of an embodiment and also shows the ability to affect the tensile-split wing growth in another direction along the same plane and to intersect multiple wellbores emanating from a single wellbore.

In embodiments, geothermal well completions may target granite and other impermeable formations, which are extremely robust, may act like casing, and will not collapse. FIG. 10C is a three-dimensional projection of an embodiment that shows the ability to affect the tensile-split wing growth in another direction along the same plane and to intersect multiple laterals emanating from a single well. In embodiments, two wells 380 and 385 may be present. In embodiments, well 380 with lateral 400 may be an injector and may be cased and cemented. In embodiments, well 385 may be a producer with three laterals 405, 505, and 525. In embodiments, induced tensile-split conduit 530 may emanate from lateral 400. In embodiments, tensile-split conduit 530 may be the first of many conduits that may emanate from this well 380 in lateral 400. In embodiments, twenty or more conduits may be spaced along a 5,000 feet lateral length, wherein the twenty or more conduits may be strategically placed along lateral 400 of well 380. In embodiments, the hydraulic pressure as shown by pressure gauge 425 may be elevated to slightly below tensile shear pressure as shown by the arrow pointing to a value of approximately 25. In embodiments, points 435, 515, and 535 may be the points where the conduit 530 intersects laterals 405, 505, and 525, respectively. In embodiments, fluctuations in pressure as shown on pressure gauges 425 and 420 may indicate hydraulic communication. For example if the pressure in gauge 425 were to increase from 25 to 29 it would be a good indication the conduit 530 had come in contact with one of the laterals 405, 505, or 525. In embodiments, other downhole gauges (not shown) may also be employed to assist in determining if contact with the tensile stress emanating from point 415 has been made with laterals 405, 505, and 525. In embodiments, the pressure may also be reduced in well 385 to assist in determining communication with the tensile stress conduit 530 emanating from point 415. Likewise, in embodiments sleeves (not shown) may be added to well 385 to segregate laterals 405, 505, and 525 to aid in isolating zones for later production control or for aid in ensuring communication with laterals 405, 505, and 525 during the tensile-splitting process. It will be apparent to one skilled in the art that a single wellbore would not be limited to the three laterals shown, but four or more laterals are also possible. In embodiments, multilateral junctions for all of TAML Levels 1-6 (TAML-"Technology Advancement of MultiLaterals") may be employed at the points where the laterals are tied to the parent wellbore. In SPE 51244, M. Chambers discusses the 6 different multi-lateral junction options from an entirely open hole with no casing, to a pressure containing vessel. In embodiments, laterals may be added to the parent well for a fraction of the cost of drilling a new well and may serve the same purpose. In embodiments, the more laterals, and thus larger the area of take points, the greater amount of heat that may be extracted for a given well. In embodiments, four laterals, each present at one of the four points of a compass, may be the most desirable footprint. This method of alternating wellbore pressures between conduit-intersected laterals to encourage the conduit to come into contact with, or grow away from, those and other laterals, may be referred to as the Conduit Propagation Direction Control Procedure (CPDCP).

Figure 10D:
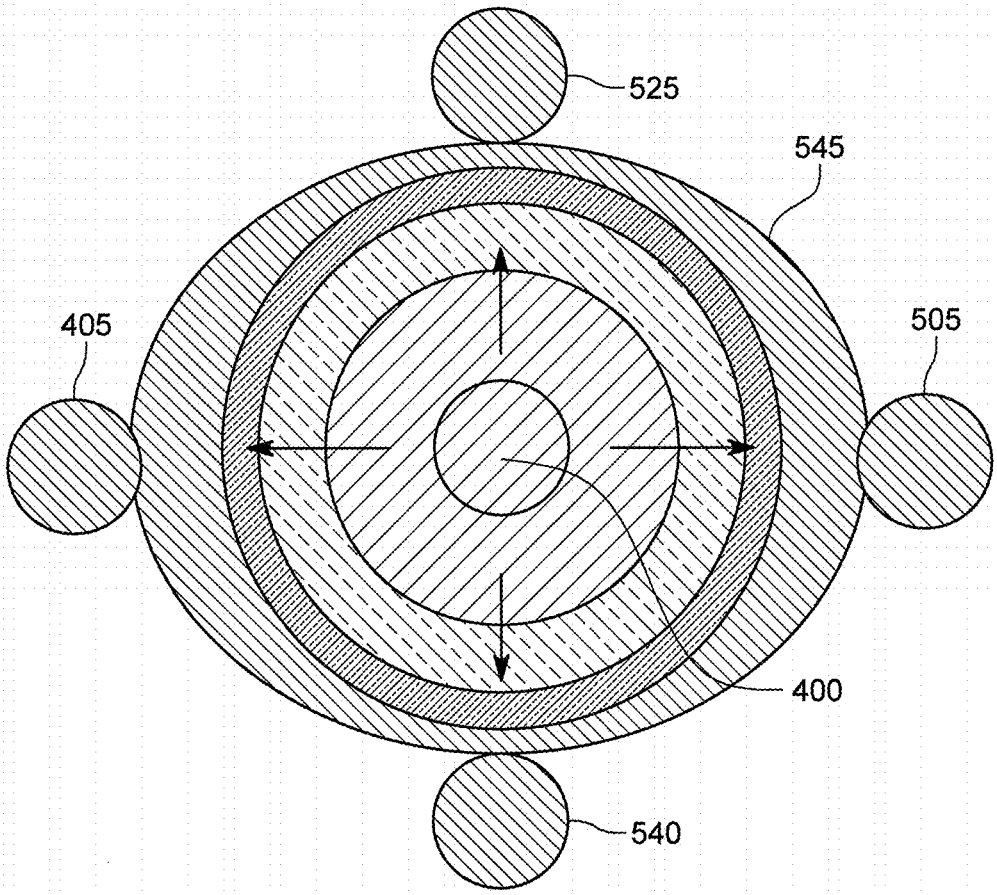
FIG. 10D illustrates is an end view illustrating an embodiment of a tensile-split conduit intersecting multiple wellbores.
Figure 11A:
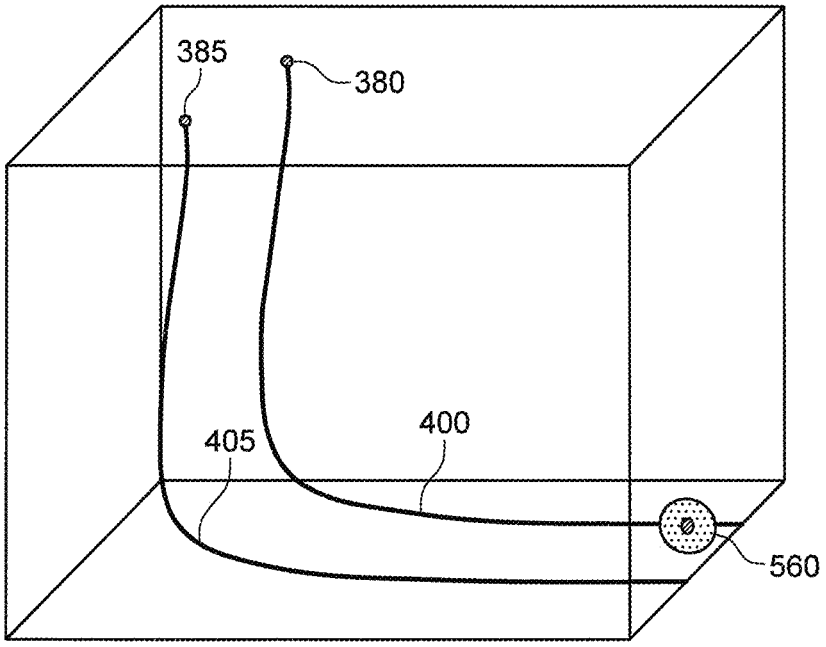
FIG. 11A illustrates an embodiment of a method suitably employed for completing a geothermal well using an enhanced geothermal completion direct contact method.
Figure 11B:
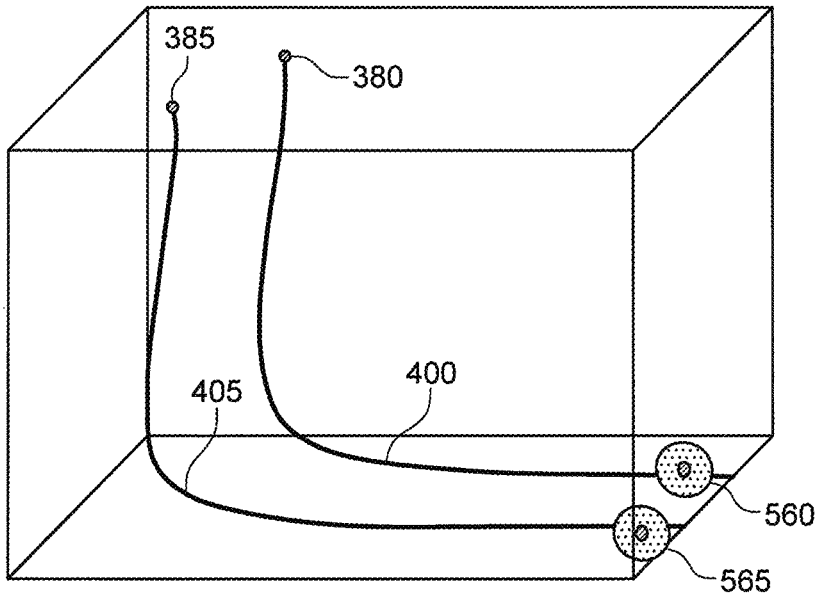
FIG. 11B illustrates an embodiment of a method suitably employed for completing a geothermal well using an enhanced geothermal completion direct contact method.
Figure 11C:
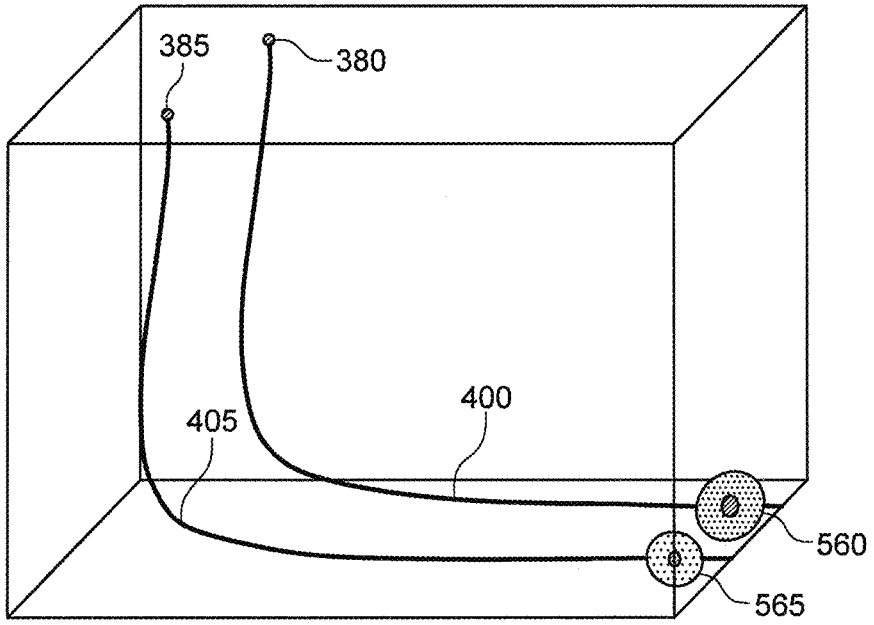
FIG. 11C illustrates an embodiment of a method suitably employed for completing a geothermal well using an enhanced geothermal completion direct contact method.
Figure 11D:
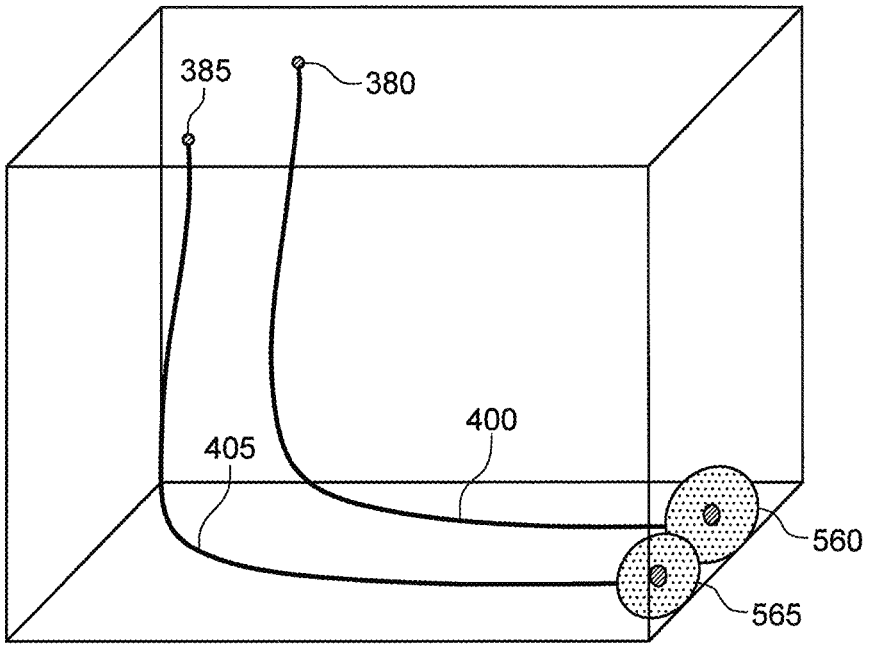
FIG. 11D illustrates an embodiment of a method suitably employed for completing a geothermal well using an enhanced geothermal completion direct contact method.
Figure 11E:
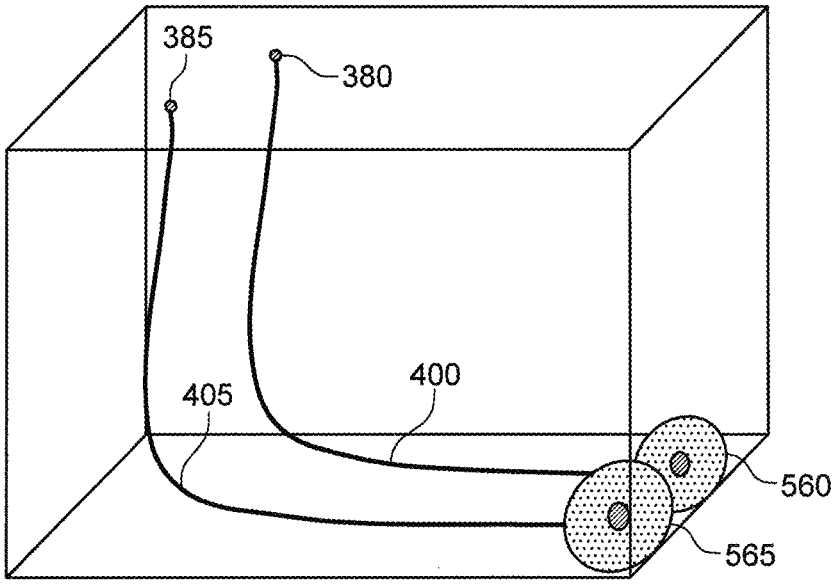
FIG. 11E illustrates an embodiment of a method suitably employed for completing a geothermal well using an enhanced geothermal completion direct contact method.
Figure 11F:
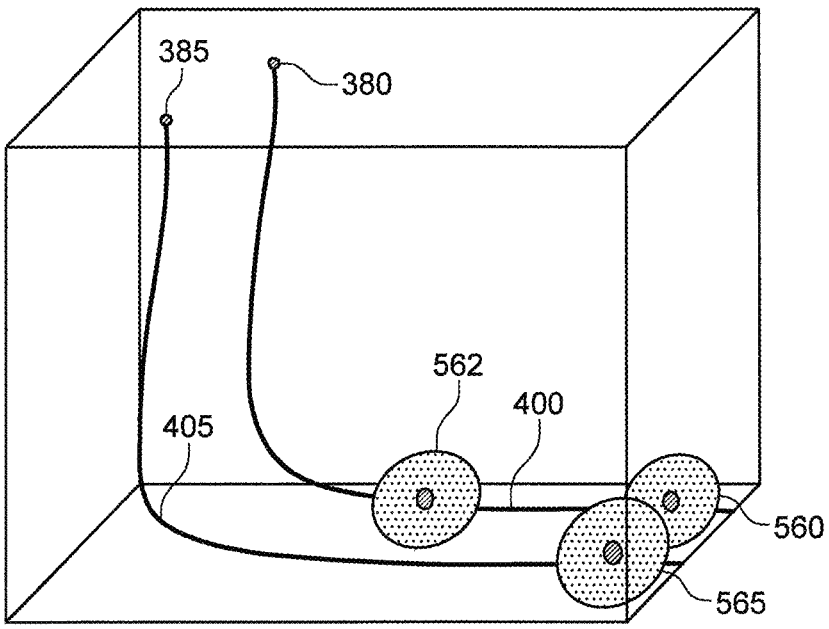
FIG. 11F illustrates an embodiment of a method suitably employed for completing a geothermal well using an enhanced geothermal completion direct contact method.

In embodiments, FIG. 10D shows an end view of injector lateral 400 and four producer laterals 405, 505, 525, and 540 which emanated from a single multilateral well. A conduit 545 has been created by means of pumping fluid into lateral 400 above the tensile-splitting pressure. During the conduit creation process, as conduit 545 expands radially away from lateral 400, pressures in laterals 405, 505, 525 and 540 may be raised or lowered as appropriate to encourage the radial expansion of conduit 545 to come in contact with each lateral. For example, if the pressure in lateral 405 were set at a pressure slightly below the maximum shear stress and conduit 545 intersected lateral 405, then the pressure could be raised to encourage the conduit 545 to stop growing in the direction of lateral 405 and start growing toward laterals 405, 505, 525, and 540. This process can be repeated as the conduit 545 intersects other laterals.

Further, in FIG. 10D the dark arrows show the direction of radial expansion away from lateral 400 toward the four laterals 405, 505, 525, and 540.

Disclosed herein are one or more methods, systems, and/or apparatuses suitably employed for enhancing tensile-splitting (or hydro-shear) conduit parameters in a subterranean formation. As used herein, reference to enhancing tensile-splitting (or hydro-shear) conductivity may include the modification of a conduit's length, width, height, and/or flow conductivity. Further disclosed is the interaction of the tensile-split (or hydro-shear) conduit by affecting the formation stress properties from two or more different wells with laterals suitably placed in the same plane of orientation. Returning to FIGS. 6A and 6B, an embodiment of a method suitably employed for completing a geothermal well using an Enhanced Geothermal Direct Contact Method is also illustrated. In embodiments, the Direct Contact Method compromises performing operations in lateral 400, which may be an injector well, while simultaneously performing operations or monitoring data in lateral 405, which may be a producer well. In embodiments, the laterals 400 and 405 may reside in the same reservoir and may be oriented in the same plane of stress regime. The following Table 1 shows steps for the corresponding pressures and pump rates for each well 380 and 385.

TABLE 1

| | Injector 380 - Lateral 400 | | | | | Producer 385 - Lateral 405 | | | | |
|---|---|---|---|---|---|---|---|---|---|---|
| Step | Procedure | FIG. | Item | Gauge 420 Reading (psi) | Pump Rate (BPM) | Procedure | FIG. | Item | Gauge 425 Reading (psi) | Flow Rate (BPM) |
| 1 | Breakdown Formation | 6A | 415 | 7500 | 5 | Monitor Pressure* | 6A | 405 | 5000 | 0 |
| 2 | Pump Pad | 6A | 410 | 8500 | 25 | Monitor Pressure* | 6A | 405 | 5000 | 0 |
| 3 | Pump Pad | 6B | 430 | 8500 | 25 | Pressure Contact | 6B | 435 | 6200 | 0 |
| 4 | Pump Proppant | 6B | 430 | 8000 | 25 | Monitor Fluid | 6B | 435 | 7000 | 4 |
| 5 | Stop Pumping | 6B | 430 | 6500 | 0 | Proppant Noted | 6B | 435 | 6500 | 0 |
| 6 | Observe Pressure | 6B | 420 | 6200 | 0 | Bleed to Closure Pressure | 6B | 435 | 6200 | 1 |
| 7 | Injectivity Test | 6B | 420 | 3000 | 2 | Flow Well | 6B | 435 | 2800 | 2 |

In embodiments, in step 1 the formation may be broken down and the conduit initiated in injector lateral 400, while simultaneously pressuring producer lateral 405 adjacent to the created conduit 410 in injector lateral 400 to slightly below tensile-splitting pressure.

In embodiments, in step 2, pad (stimulation fluid without a means to prop or hold open the fracture without pressure) may be pumped into conduit 410 while monitoring the pressure in lateral 405. In embodiments, this process may be continued until pressure significantly changes in lateral 405 indicating the conduit 430 has intersected lateral 405 at point 435, as shown in FIG. 6B. This can be seen in step 3 where the pressure in lateral 405 has increased from 5,000 psi in step 2 to 6,200 psi in step 3.

In embodiments, in step 4 proppant may be pumped into injector lateral 400 and monitored in producer lateral 405 by circulating fluid to surface or through downhole sensors. This can be seen in step 4 where the flow rate in lateral 405 has increased from 0 BPM to 4 BPM. The corresponding pressure has also increased from 6,200 psi to 7,000 psi.

In embodiments, in step 5 proppant may be detected in sufficient quantities in producer lateral 405 and pumping may be stopped. This can be seen where the pump rate and flow rate are both 0 BPM and the pressures are the same 6,500 psi.

In embodiments, in step 6, while observing the pressure in injector lateral 400, the pressure may be reduced or bled off in producer lateral 405 until closure of the tensile-split wall aperture onto the proppant has occurred. In embodiments, if there is no need to evaluate the aperture closure, operations may be concluded. This can be seen in both laterals 400 and 405 where the pressures had decreased to 6,200 psi while flowing lateral 405 at 1 BPM.

However, in embodiments where there may be a desire to test the conduits' permeability and communication to ensure sufficient pump rates can be achieved at desired pressures, operations may proceed to step 7 wherein an injection rate may be established in injector lateral 400, and the flow rate in producer lateral 405 may be choked to match the injection rate for injector lateral 400 to establish the circulation rate and pressure in both laterals 400 and 405. This can be seen where the pump rates are identical and pressures are different due to friction losses in the reservoir.

In embodiments, if pressure increases in the injector lateral 400 and then reaches a plateau, the rate may be acceptable, and operations may cease and proceed to step 8 where operations may move to the next tensile-splitting location. However, in embodiments, if pressure in injector lateral 400 continues to rise, a decision may be made to either retreat and restart at step 2 or accept the lower permeability and communication.

FIGS. 11A, 11B, 11C, 11D, 11E, and 11F illustrate graphically an embodiment of a method suitably employed for completing a geothermal well using an Enhanced Geothermal Enhanced Connection Method. In embodiments, the ECM generally comprises performing operations in an injector well 380 with a lateral 400 while simultaneously performing operations or monitoring data in a producer lateral 405. In embodiments, the laterals of both injector well 380, lateral 400, and producer well 385, lateral 405, may reside in the same reservoir and may be oriented in the same plane of stress regime. In embodiments, FIGS. 11A, 11B, 11C, 11D, 11E, and 11F graphically show the growths and corresponding well pressures and pump of flow rates for each step for conduits. Negative flow rates indicate fluid is moving out of the wellbore rather than into the wellbore.

In embodiments, step 1 may comprise the formation being tensile-split using water or gel to initiate conduit 560 in lateral 400, while simultaneously monitoring the pressure of lateral 405 in well 385 at a location normal to the created conduit 560 in well 380. This can be seen in the following Table 2 where the pressure and rate in well 380 is higher than that in well 385. In embodiments, an operator may start stimulation at the toe of well 380, which may be an injector well, through sleeve or perforations (pumping gel or fresh water).

TABLE 2

| | Well 380-Injector | | Well 385-Producer | |
|---|---|---|---|---|
| Step | Surface Gauge Press (psi) | Pump/ Flow Rate (BPM) | Surface Gauge Press (psi) | Pump/ Flow Rate (BPM) |
| 1 | 7500 | 20 | 6000 | 0 |
| 2 | 6500 | 0 | 6000 | 0 |
| 3 | 6000 | 0 | 7500 | 20 |
| 4 | 6000 | 0 | 6000 | 0 |
| 5 | 8500 | 25 | 6500 | 0 |
| 6 | 6500 | 0 | 8500 | 25 |
| 7 | 7000 | 0 | 8500 | 25 |

TABLE 2-continued

| | Well 380-Injector | | Well 385-Producer | |
|---|---|---|---|---|
| Step | Surface Gauge Press (psi) | Pump/ Flow Rate (BPM) | Surface Gauge Press (psi) | Pump/ Flow Rate (BPM) |
| 8 | 2000 | 0 | 2000 | 0 |
| 9 | 2500 | 2 | 2300 | −2 |
| 10 | 0 | 0 | 0 | 0 |
| Formation Parting Pressure = 6,200 psi | | | | |

In embodiments, in step 2 after pumping and creating conduit 560 of approximately 50 feet emanating from lateral section 400, the rate may be stopped and the pressure held at above fracture closure stress. In alternative embodiments, the pressure after stopping pumping in well 380 may be bled to below fracture closure pressure. This can be seen in Table 2 where both well 380 and well 385 show 0 rate but the pressure is higher in well 380 than well 385.

In embodiments, in step 3 pressure may be bled to a level slightly below the fracture initiation pressure in well 380 while simultaneously tensile-splitting lateral section 405 in well 385 using water or gel at a point along the lateral section 405 within 20 feet of well 380, lateral section 400's most recent tensile-splitting. In embodiments, stimulation may be started at the toe of well 385, which may be a producer well. This can be seen in Table 2 where the pump rate in well 385 is 20 BPM. In embodiments, pumping may be continued in well 385 until a pressure increase is noted in well 380 or, in an alternative embodiment, until after the conduit 560 has extended approximately 50 feet from the initiation point in well 385 and the pumping ceased.

In embodiments, in step 4 pressure is monitored in well 380 while creation of conduit 565 is underway in well 385. This is shown in Table 2 where contact has been made because the pressure in well 380 increased from 6,000 psi to 6,500 psi.

In embodiments, in step 5 the proppant material may then be pumped into well 380 until significant pressure is noted in well 385 or proppant is recovered. This can be seen in Table 2 where the pressure in well 385 is 6,500 psi and well 385 is producing fluid to surface as noted by the negative 5 BPM rate.

In embodiments, in steps 6, 7, and 8, if contact has not been made in well 385 by pumping in well 380, a designed tensile-splitting may be emanated from well 385 while monitoring pressure in well 380. Pumping is continued until contact is made. At the conclusion of pumping the pressure is bled down to approximately 2,000 psi which would be a pressure below fracture closure pressure.

In embodiments, once the tensile-splitting operation has been completed, an injectivity test may be performed in step 9 by pumping into well 380 with water at the desired rate and recovering fluid from well 385. This can be seen from Table 2 where well 380 has an injection rate of 2 BPM and well 385 has a negative 2 BPM flowrate (i.e. producing to surface). The difference in pressure is attributable to the reservoir friction pressure. In embodiments, if an acceptable rate and pressure for producing operations has been achieved for that conduit, the process is complete. If not, the process may be repeated from step 1. If there were 20 planned flow conduits between well 380 and well 385, then an acceptable rate for a single conduit would be $1/20^{th}$ of the designed rate. For example, if the design rate were 20 barrels per minute (bpm) at a pressure of 3,000 psi, then an acceptable rate for one conduit would be 1 bpm at a pressure less than 3,000 psi to account for flow friction along the lateral section. Additional flow conduits can next be created further towards the heel of the lateral sections by moving to step 1, for example, conduit 562 in FIG. 11F.

In embodiments, if treating more than one pair of wells at a time, then the methods described in relation to FIGS. 11A, 11B, 11C, 11D, 11E, and 11F may be modified by applying or reducing pressure in the desired wellbore using downhole pumps or wellhead chokes to affect the growth of the conduit where first contact and communication is noted and where there is a desire to grow the conduit in the opposite direction.

FIG. 12 presents methods proposed to be employed in injector wells and producer wells when certain conditions have not been met. In embodiments, the first step in the first optional method, wherein creation of the tensile-split conduit is underway by pumping in the injector 570 and communication has not been established with the producer 575. In embodiments, the following techniques may be employed: pump diverter materials; increase pump rate in injector; increase viscosity of fluid (cross-link); decrease viscosity of fluid; and pump twice design volume, no contact-move to next tensile-split location. As the above methods are employed simultaneously in the producer 575, the pressure and rate may be raised and lowered accordingly.

In embodiments, a second optional method may involve the following. In embodiments, after pressure communication has been determined between the injector 570 and producer 575, proppant or swelling material may be introduced to the injector 570. Further, in embodiments, simultaneously proppant may be monitored in the producer 575. In embodiments, if pressure increases in the injector 570 or additional proppant quantities are desired, pressure may be raised in the producer 575 to increase the conduit aperture width. If, however, proppant is being recovered in the producer 575 and there is a desire to pack the conduit further with proppant, pressure may be reduced, and the aperture and height will decrease.

In embodiments, a third optional method may involve the following. In embodiments, if after concluding the conduit creation, injectivity is below desired rates, the conduit may be reopened, and additional proppant or swell material may be inserted. In embodiments, rates and pressures higher than the original pump treatment may be required and/or changes to the fluid viscosity may be attempted. Simultaneously, pressures in one or more producers 575 may be raised or lowered depending on the expected outcome.

In embodiments, monitoring and recording downhole pressure, temperature, seismic, temperature, and other data may enable the optimum placement of a conductive conduit between injector 570 and producer 575, or multiple injectors 570 and producers 575, to be achieved. In embodiments, this monitoring may be used for every newly constructed conduit or only used until the parameters to create the conduit are fully understood.

Figure 13:
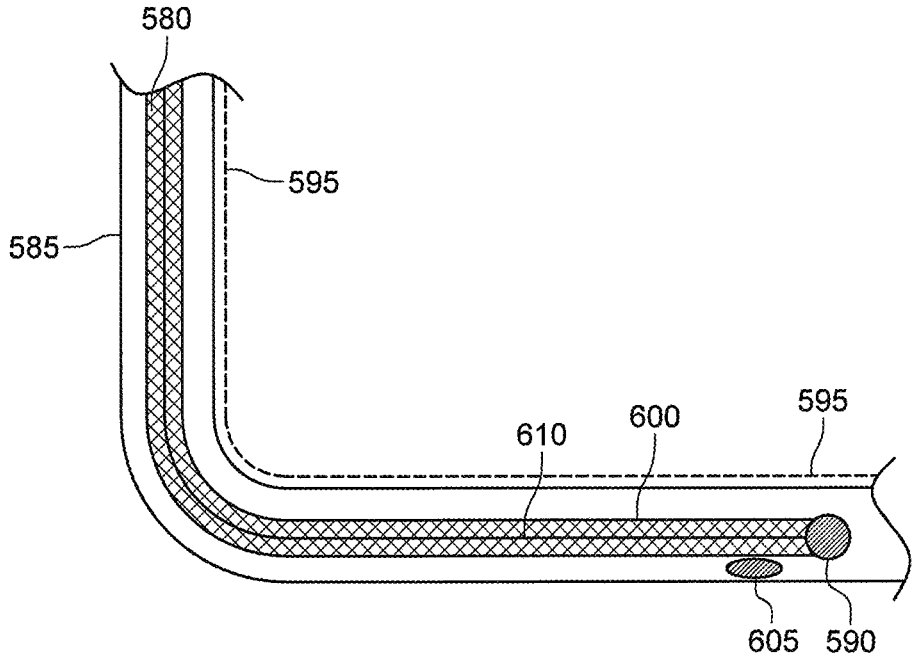
FIG. 13 presents methods and systems that may be used to permanently, or temporarily, collect treatment data.

FIG. 13 presents methods and systems that may be used to permanently, or temporarily, collect treatment data. In embodiments, well 580 may comprise a casing 585. In embodiments, casing 585 may comprise one or more sensors 590 or fiber cable 595 permanently affixed to it. In embodiments, fiber cable 595 may be used as a type of sensor to collect data such as temperature, sound, and strain every foot of its length, or fiber cable 595 may be used to transmit electrical data from the one or more sensors 590. In embodiments, coiled tubing 600 may be used as a means of conveying one or more sensors 590, fiber cable 595, and/or a control wire 610. Likewise, in embodiments the one or more sensors 590 may be employed in the casing 585 and/or on the coiled tubing 600 and RFID Tags 605 used to carry instructions to the sensors 590 or data from the sensors 590 by means of well circulation. Additionally, in embodiments, sensors 590 may comprise permanent sensors attached to the casing 585 such as pressure sensors and/or gamma ray sensors. Further, in embodiments, sensors 590 may comprise temporary sensors on coiled tubing 600 and/or wireline for monitoring surface pressure, acting as downhole sensors (e.g., pressure, gamma ray detector, noise), or collecting downhole sensor data at the surface by wire or memory tool (e.g., circulated RFID tag 605 to collect data or downloaded when pull coiled tubing 600 out of hole).

Micro Seismic is another common means used in the industry to track the creation of conduits. Typically, these types of systems are installed in adjoining wells to collect the data. As described earlier, there are two primary means to execute communication between an injector and a producer or group of injectors and producers. Many of the descriptions described above involved the DCM where fluid may be pumped from a cemented injector well to an uncemented producer well. However, at least as prevalent is the FEM, where both injector and producer wells are cemented, and both have created conduits extending towards one another. The attempt is to have the created conduits intersect or form additional branches or splays, which intersect or contact perpendicular natural fractures which will act as connection points with the bulk formation.

Figure 14A:
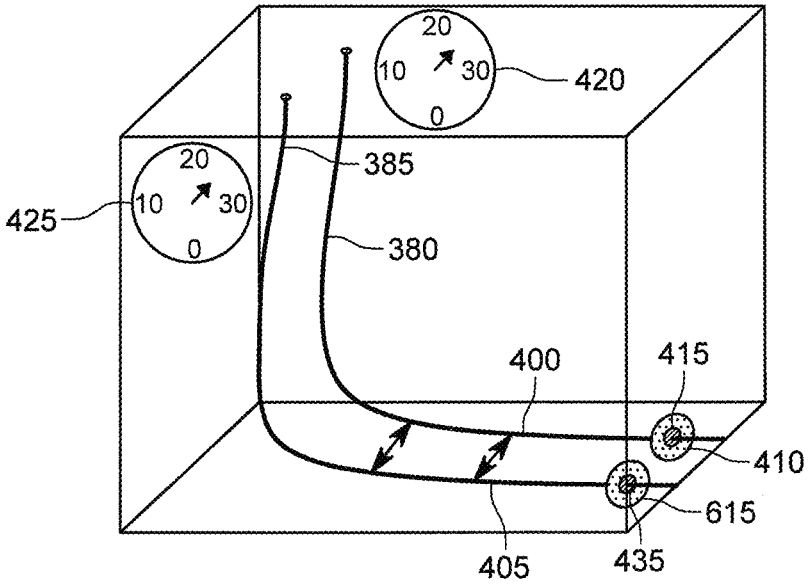
FIG. 14A illustrates an embodiment wherein two wells are simultaneously undergoing tensile-splitting towards each other.

FIG. 14A is a depiction of an embodiment wherein two wells are using the FEM process. In embodiments, well 380 may be a well with lateral 400 and tensile-split conduit 410 emanating from point 415. In embodiments, well 385 may be a well with lateral 405 parallel in the same plane to lateral 400. Further, in embodiments, well 385 may comprise tensile-split conduit 615 emanating from point 435. In embodiments, conduits 410 and 615 may not have come into contact with one another.

Figure 14B:
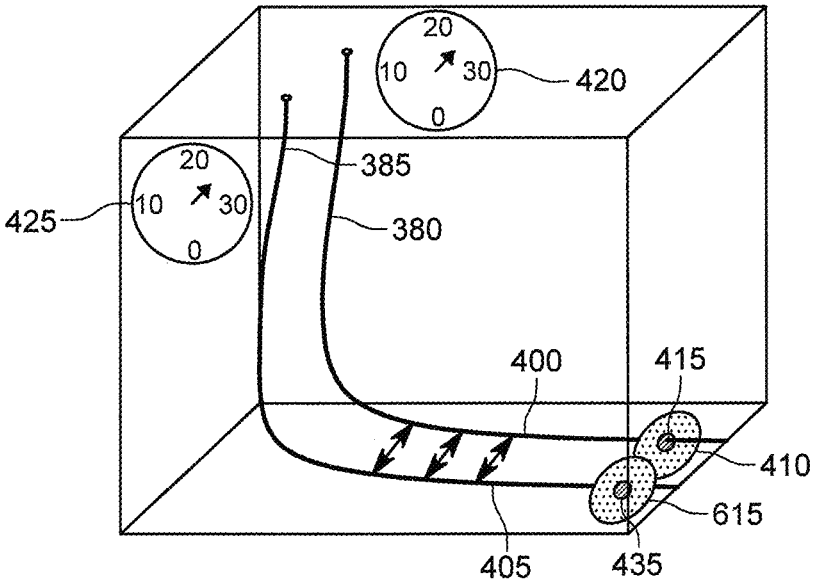
FIG. 14B illustrates an embodiment wherein the same two wells have created a flow conduit between them by means of the simultaneous tensile-splitting

In another embodiment shown in FIG. 14B, tensile-split conduits 410 and 615 may be in contact with one another or near to contacting one another.

In embodiments, the ability of the tensile-split conduits 410 and 615 to intersect may be enhanced with one or more of the following actions:

- start tensile-splitting both conduits 410 and 615 at the same time or start one conduit later than the other conduit;
- pump much higher rate and pressure in one conduit versus the other conduit;
- stop or reduce pumping in one well when intersection is noted in the other well;
- pump diverter material in one of the two wells to encourage the generation of branches or splay conduits off the primary conduit;
- pump proppant in one well while bleeding pressure in the other well;
- change the viscosity of the fluid in one conduit versus the fluid in the other conduit with for example cross-linking one, and pumping swellable material in one conduit while pumping conventional proppant in the other conduit.

The above list should not be limiting but other methods or combination of the above methods may be effective in some formations and more effective in others.

In embodiments, it may be important to locate the initiation points for tensile-split conduits in wells. Improper placement in EGS wells may limit efficient injected-fluid circulation to recover heat. In the embodiments shown in FIGS. 15A, 15B, and 15C, a planar view is depicted showing two horizontal wells 620 and 625. In embodiments, wells 620 and 625 may be cased and cemented wells. In embodiments, wells 620 and 625 may be oriented perpendicular to the maximum horizontal stress direction $\sigma_{HMax}$: In embodiments, tensile stress conduits 630, 635, and 640 may be present as well.

Figure 15A:
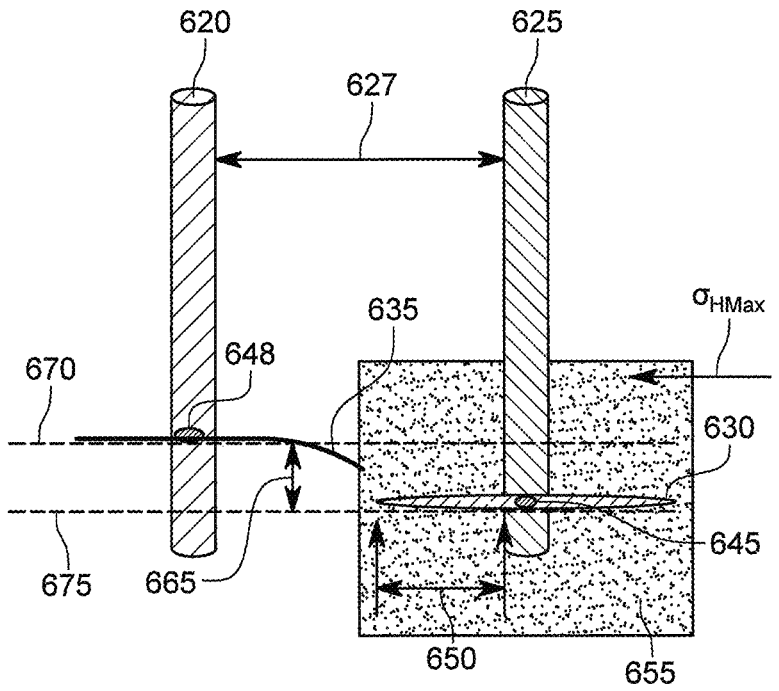
FIG. 15A illustrates an embodiment wherein a tensile-stress conduit and an affected rock stress area may be created during the stimulation of the conduit.

More specifically, FIG. 15A shows an embodiment wherein tensile stress conduit 630 emanating at point 645 in well 625, having a conduit-wing length 650, and an affected rock stress area 655 (noted by the dotted field) may be created during the stimulation of conduit 630. In embodiments, stress area 655 may be approximately equal in width to conduit-wing length 650. Further, a distance 627 is shown, and distance 627 is the distance between well 620 and well 625. Additionally, FIG. 15A shows an embodiment wherein conduit 635 emanates from a point 648 in well 620.

Figure 15B:
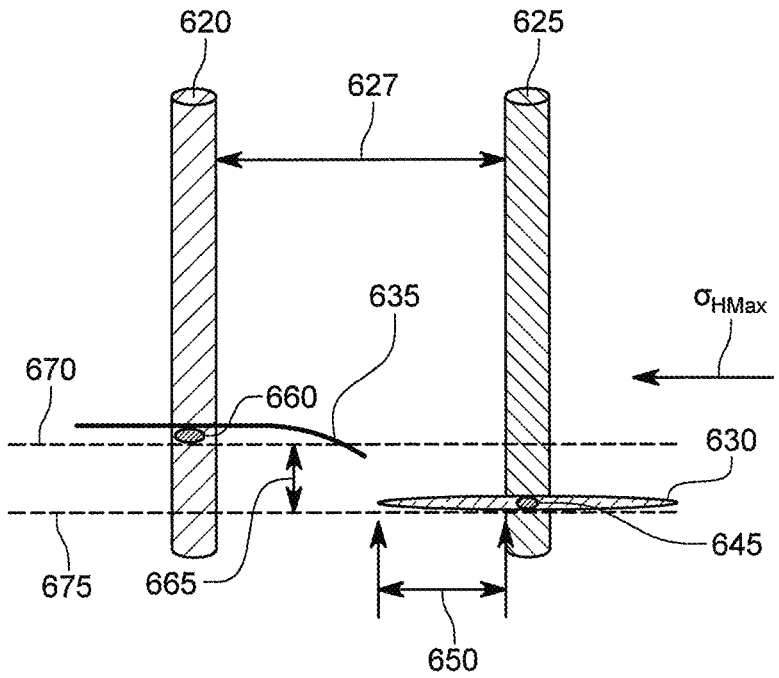
FIG. 15B illustrates two wells wherein pumping of a first conduit has concluded and tensile-splitting of a second conduit is underway.

In the embodiment shown in FIG. 15B, wells 620 and 625 are depicted. In embodiments, pumping of conduit 630 has concluded and stimulation of conduit 635 is underway emanated from point 660 and growing both toward and away from well 625. In embodiments, initiation point 660 of conduit 635 is shown, and distance 665 is the distance from parallel lines 670 and 675 through the two conduits parallel to the $\sigma_{HMax}$. In embodiments, distance 665 should be less than 20 feet or conduit 635 will be too far away and will not curve and intersect conduit 630. Further, in embodiments the conduit-wing length 650 may be greater than half of the distance 627.

Figure 15C:
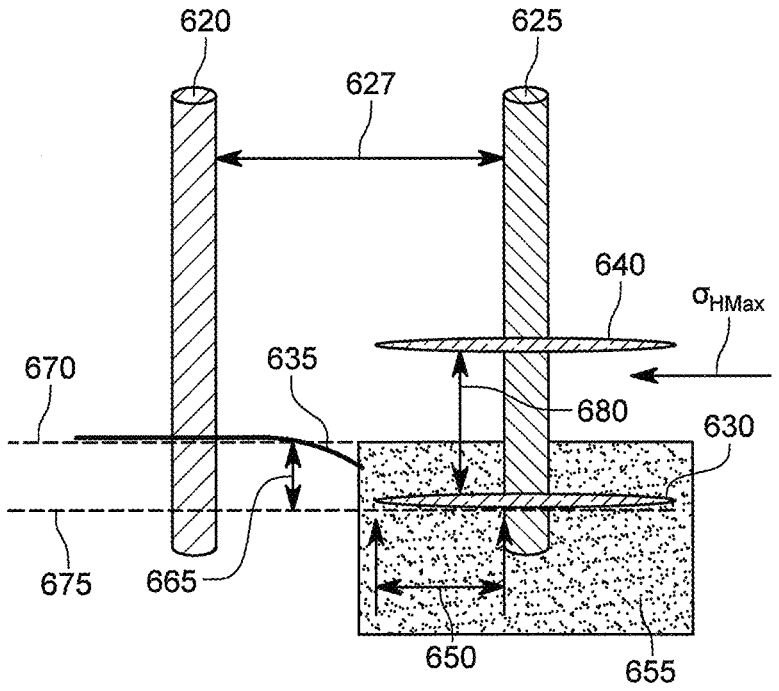
FIG. 15C illustrates an embodiment with two conduits and the required minimum distance between orthogonal axes after tensile-splitting has been completed.

In embodiment, FIG. 15C illustrates conduits 630 and 640 and the distance 680 between them. In embodiments, distance 680 may be approximately equal to or greater than distance 665, which may place the newly created conduit 640 out of the altered stress zone 655 and therefore will propagate parallel to the $\sigma_{HMax}$. If conduit 640 were closer, it would veer away from conduit 630. Further, in embodiments the conduit-wing length 650 may be greater than the distance 680.

Figure 16A:
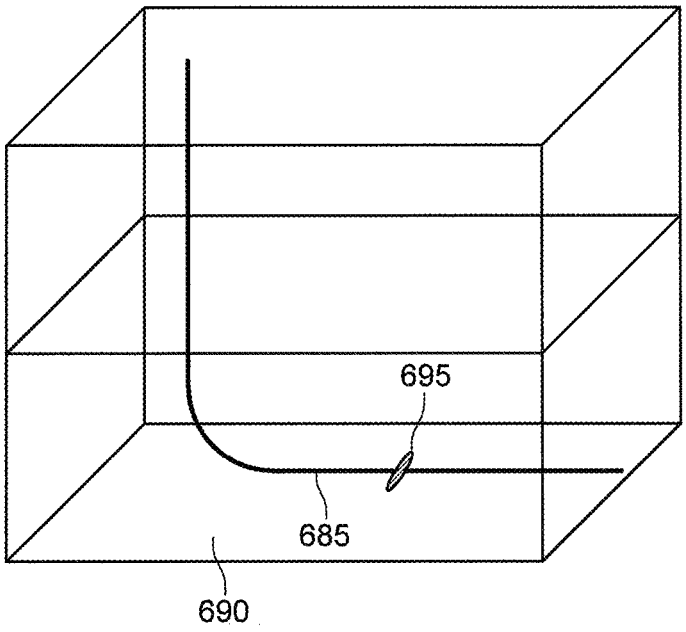
FIG. 16A illustrates an embodiment of a well in a formation.
Figure 16B:
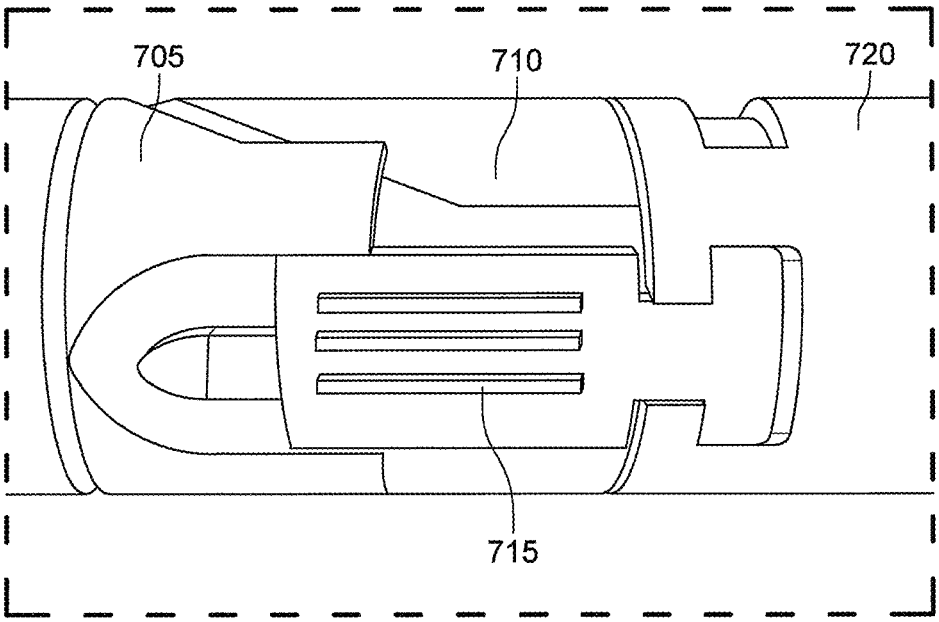
FIG. 16B illustrates an embodiment of a mechanical rock-cracking tool used to create a fissure or multiple fissures.
Figure 16C:
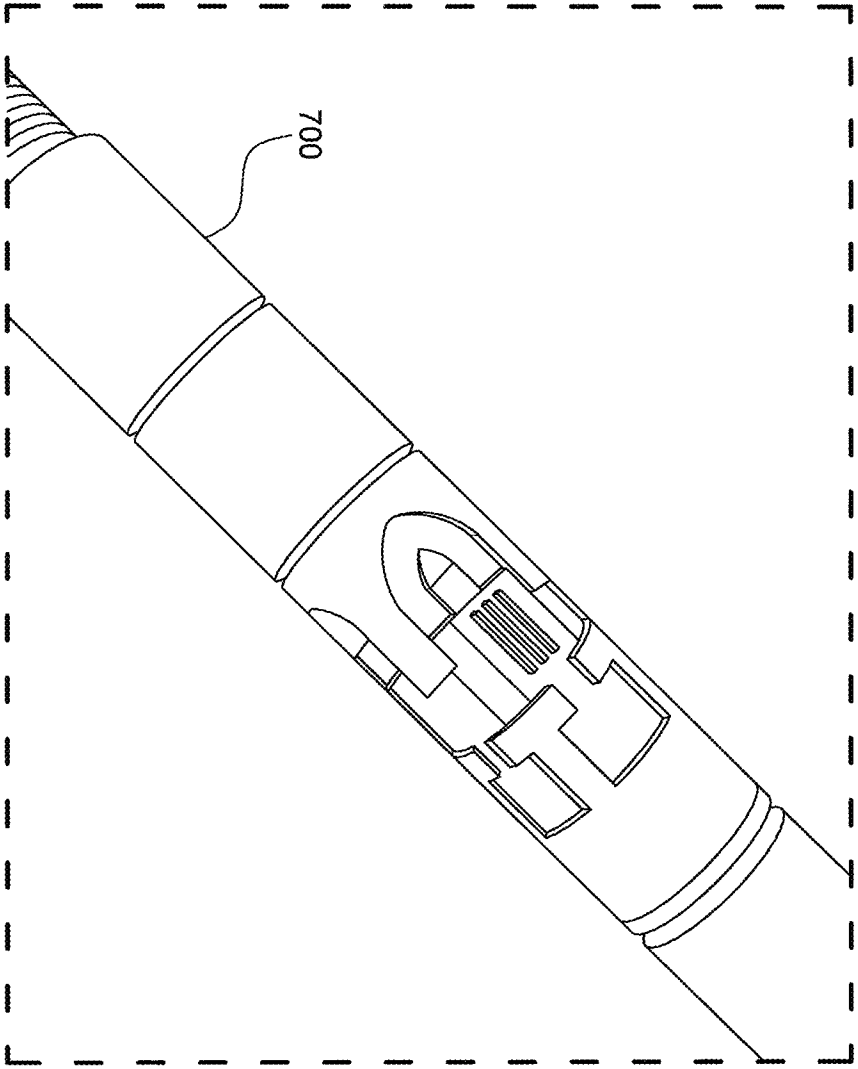
FIG. 16C illustrates an embodiment of a mechanical rock-cracking tool prior to testing.

The DCM method employs an open hole methodology to enhance the odds of intersecting a conduit deployed from a parallel horizontal well. To enhance the odds further the target well may be tensile-split beforehand. FIG. 16A illustrates an embodiment of a well 685 in formation 690. At a point 695 the formation 690 has been mechanically stressed to instigate a perpendicular fissure or multiple fissures radiating out and away from the well 685. FIGS. 16B and 16C illustrate a tool 700, which has been used in tests since the late 1990s to create such a fissure or multiple fissures, which contains cones 705 and shear pads 710 containing ridges 715 and a retainer 720. The tool 700 is actuated by a hydraulic piston and retracted with pipe movement. Similarly, external casing packers employing rubber expandable elastomeric elements may also be used to stress the formation 690 and create fissures emanating from the well 685. Having an area of pre-fissured rock would enhance the likelihood of contact since the tensile-split conduits would need to be extended a shorter distance.

In embodiments, during the completion of a pair of lateral sections where one is a cased hole and the other is an open hole, sand or other proppant added to the stimulation fluid in the cased lateral may enter the open hole lateral once connection is made. There may even be a desire to flow the open hole lateral during the completion to enhance the communication and placement of proppants between the laterals. Once fluid movement has stopped, sand may settle and form a bridge or plug in the open-hole lateral preventing future fluid movement.

To prevent bridges from forming, or to remove them after forming, a tubular string may be inserted in the open hole lateral at a point near the intersection of the stimulation fluid from the injector. Fluid may be circulated from the surface to the end of the tubing in a conventional or preferred reverse circulation mode to remove sand or other proppants or debris from the lateral. It may be preferable to have the tubular circulation string in the vertical part of the well during the stimulation and use it to remove debris after the conclusion of the stimulation.

A pump rate of 2 to 5 barrels per minute (Note: rate is for 2⅜" tubing) must be used to keep the solids in suspension. Pads of gel and/or surfactants may be added to the fluid to assist in the removal of the fill.

The tubular string may be threaded and coupled or a continuous coiled tubing string. Nozzles, beveled ends, or other tools/accessories may be added to the string to assist in the debris removal or other processes. Typical threaded and coupled or coiled tubing sizes used in this process are 2", 2⅜", and 2⅞" although smaller and larger sizes may be used.

The process described above may be used multiple times during the completion process. For example, the process may be used before, during, or after the completion of each stage. The process may also be used in multiple laterals of a multilateral well by simply moving the tubular string between laterals.

Figure 17:
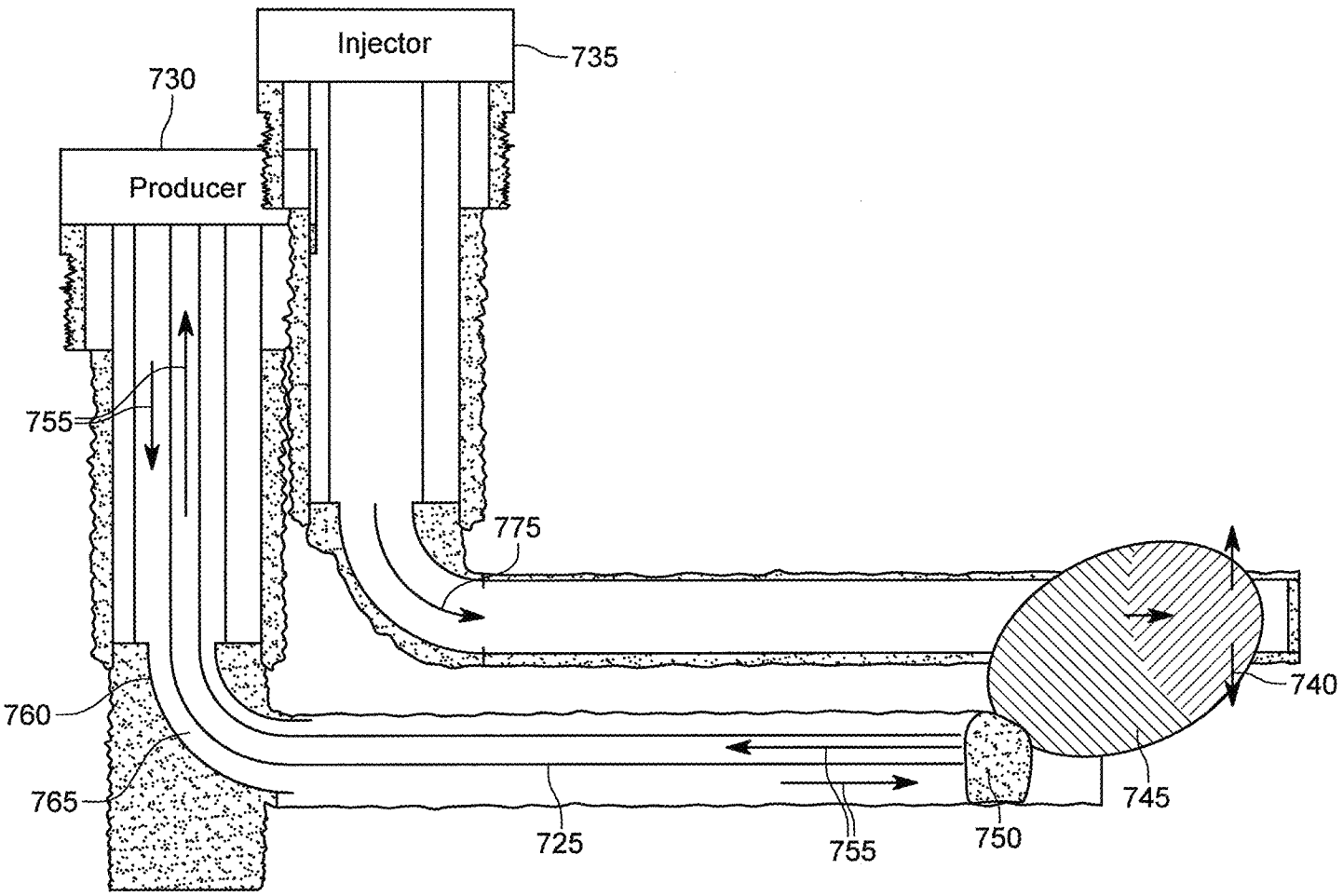
FIG. 17 illustrates an embodiment of a system whereby a tubular member may be used to remove debris from a producer lateral.

It is important to have unobstructed laterals during and after the creation of conduits between injector and producer laterals. FIG. 17 illustrates an embodiment of a system whereby a tubular member 725 may be used to remove debris from a producer well 730. Represented are an injector 735 and producer well 730. Injector well 735 may be a cased lateral and may have a sleeve or perforation 740 from which tensile-split conduit 745 contacts producer well 730 creating a debris plug 750. To remove debris plug 750, cleanout fluid may be pumped down the annulus of tubular member 725 breaking up debris plug 750 and escorting it up tubular member 725 and out of the producer well 730. Arrow 755 shows the direction of flow of the stimulation fluid down the injector wellbore 735 and out the port or perforation 740. Debris plug 750 may be a solid plug or simply be loose grains of sand or other particles restricting flow. The cleanout fluid may be water, gelled water, or a combination of water and gelled water pads to assist in capturing and removing of the debris solids in the debris plug 750. If more than one producer lateral is present, the tubular member 725 may be moved between laterals.

At the conclusion of the creation of flow conduits and wellbore cleanout, tubular member 725 may be positioned near the heel 760 of the well 730 to aid in assisting the producer well 730 to flow through the addition of a lighter fluid or a gas. The tubular string 765 may also be used to aid in circulating kill fluid if the need arises.

Additionally, evenly distributing the injected flowrate between each of the created conduits between a horizontal injection well and one or more horizontal production wells is of utmost importance in the completion design. However, the fluid loses pressure energy to friction as it flows from the source of the injection fluid (the "heel") to the far end of the horizontal section (the "toe"). Because of the higher pressure at the heel, more fluid is forced through the created conduits at the heel than at the toc. As mentioned previously, coiled-tubing-adjustable casing sleeves and perforation distribution are both means of evenly distributing the flowrate through the conduits. In a further embodiment, the relative lateral placement of injection and production wells may be an effective means to evenly distribute flow. In embodiments, the laterals of an injection and a production well may reside in the reservoir at a similar vertical depth, but with the heels of the two laterals placed further apart than the toes, whereby the injected fluid has a further distance to flow between the injector and producer wells at the heels than at the toes. This results in a relatively lower flowrate through the heel conduit due to the increased frictional energy losses from the longer flow path. For example, if the injection and production wells were placed 400 feet apart at the heel and 200 feet apart at the toe, the fluid flowing through the conduit at the heel might suffer twice the pressure drop as that at the toc. Computer modeling is used to balance the frictional energy losses suffered by the fluid flowing from heel to toe along the injector lateral (and toe to heel in the producer lateral) against the frictional energy losses suffered by the fluid flowing a longer distance through the reservoir from the injector to the producer at the heel than at the toc. The modeling is done at a range of fluid flowrates of economic interest.

Further, to achieve optimum placement and cost it may be required to use the FEN method near the heel and DCM method near the toe of the laterals of the injector and the producer wells. In an embodiment the laterals of injector and producer wells are drilled in a reservoir at the same vertical depth in the reservoir. The heels are placed further apart than the toes. The injector is cased and cemented across the entire lateral. Approximately one half of the lateral of the producer is cased and cemented and the other half is open hole or with an uncemented casing. For example, 20 injector entry points into conduits may be placed across a 5,000-foot lateral. If a total fluid flowrate of 20 barrels per minute (BPM) were pumped from the surface, an average allocation would be 1 BPM exit the injector at each conduit entry point. However, because there is more reservoir contact area between the heels of the wells than between the toes, to achieve a stable flood-front, and so minimize bypass of heat, more fluid would need to be injected near the heel than the toe to create an identical reservoir contact time. Therefore, injection rates near the heel will need to be higher rather than evenly distributed across the horizontal section.

Reusing suspended and abandoned wells originally drilled to explore for or to produce geothermal energy or hydrocarbons may reduce the cost and risk of constructing EGS horizontal wells. In many wells drilling to the target vertical depth to start the lateral can be more than half the total drilling cost, conferring material economic advantage to this claim. In addition, reusing existing wells may hasten permitting and reduce hurdles for other environmental or regulatory requirements. The mechanical and chemical integrity and longevity of the candidate well, and the suitability of the rock formations for EGS, are first verified using well records, cased logging, and other technologies. A window is then cut in the well casing at the appropriate depth, or the well is deepened to the target depth by drilling through the casing shoe at the bottom of the well. In both cases, the "build" section, to convert the well direction from vertical to horizontal, and the lateral are then executed.

When drilling long laterals in geothermal reservoirs containing natural fractures, there is a need to isolate sections of the lateral to allow proper control of fluid movement while simultaneously preserving the natural fracture wellbore connection of zones not requiring isolation. In embodiments, a casing string may be equipped with cementing sleeves containing open and closed positions only, as well as with isolation sleeves containing open, closed, and choked positions. The sleeves may be approximately evenly spaced apart such that zones approximately 350 feet in length may be available for flow and for large cement isolation zones. Zones of lengths ranging from 30 feet to 1,000 feet or more would also be possible. The zones may be spaced appropriately such that when used with the DCM method there would be a large target for the offset well to intersect with a newly created tensile-split conduit. Likewise in reservoirs not containing natural fractures, the sealed wellbore may allow new tensile-split conduits to be created through the isolation sleeves.

Additionally, in embodiments sleeves may be open, closed, or choked with shifting dogs deployed on coiled or jointed tubing. An example of this method is the Kobold Completions system referenced in Canadian patent CA2928453C.

In embodiments, small batch-mixed slurries of cement may be pumped into the annulus between the blank casing joints and the formation to form a seal. A circulation sleeve near the heel of the well (or elsewhere in the horizontal casing) may provide a path for return fluids. The newly completed cement plugs may then be used as a seal for flow control or as an isolation method for creating new tensile-split conduits. In embodiments, conventional high-temperature cement formulations, barite, resins, or other products could be used to form sealing plugs in the annulus between the casing and the formation.

Figure 18:
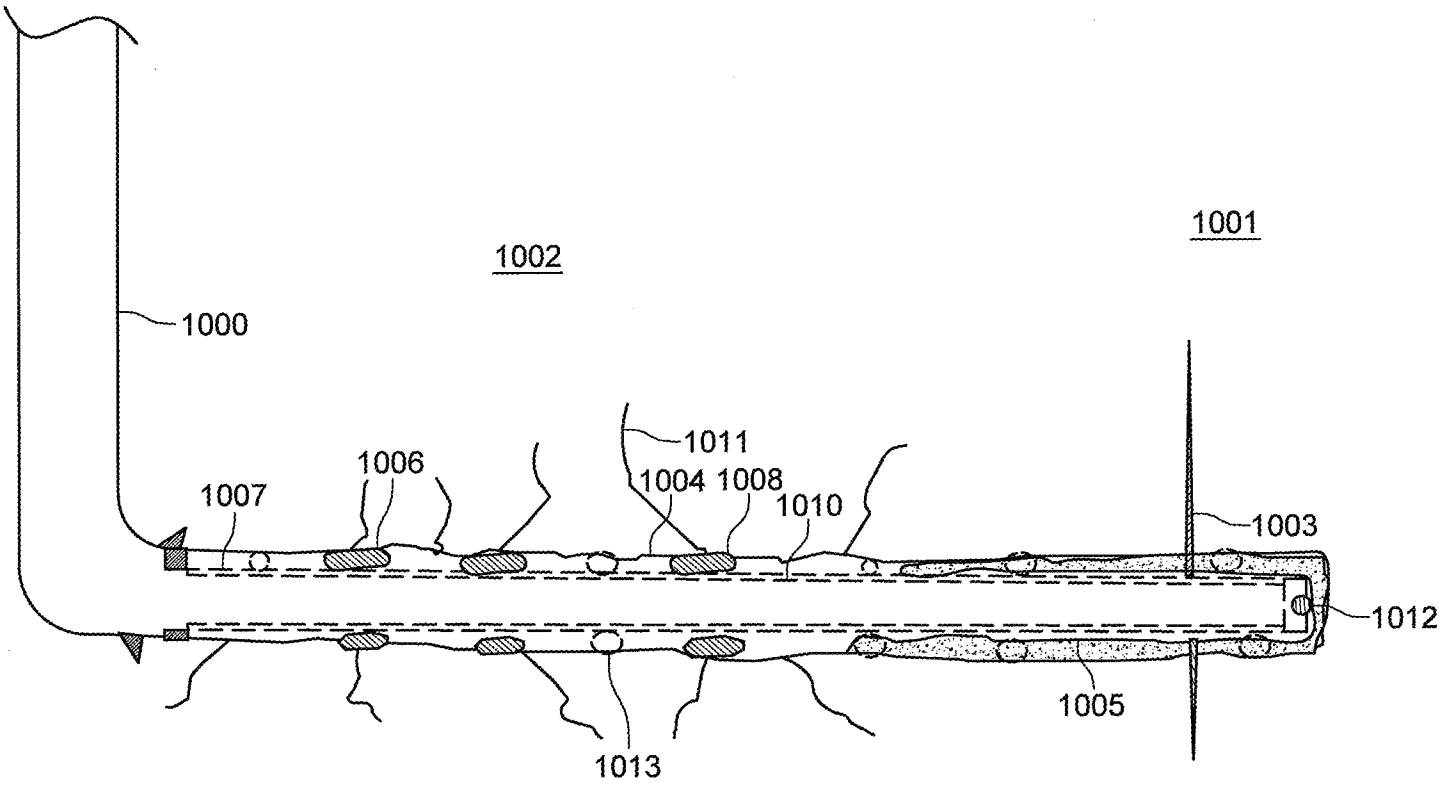
FIG. 18 illustrates an embodiment of a wellbore in a non-fractured formation and a fractured formation.

FIG. 18 illustrates a wellbore 1000 in a non-fractured formation 1001 and a fractured formation 1002. In embodiments, the lateral of well 1000 contains non-cemented sections 1004 and cemented sections 1005. In embodiments, a propped tensile-split conduit 1003 may be created in one of the cemented sections 1005 in non-fractured formation 1001. In embodiments, other sections of the wellbore 1000 in the fractured formation 1002 may contain cement isolation plugs 1006. In embodiments, a circulation sleeve 1007 may be located near the heel of the well 1000 for use as a conduit for returned circulation fluids in the casing open hole annulus. In embodiments, cemented sleeves 1008 and flow control sleeves 1009 may be placed between casing joints 1010 as desired. In embodiments, areas containing natural fractures 1011 may open for flow through flow control sleeves 1009. Likewise flow control sleeves 1009 may also be open for flow from propped tensile-split conduit 1003. In embodiments, a float shoe 1012, standoff band turbalizers 1013, and other conventional cementing accessories may also be added to enhance cement placement. In embodiments, coiled tubing and jointed tubing conventional fracturing shifting tools may be deployed to function the flow control sleeves 1009 (open/close/choke), circulation sleeve 1007 (open/close), and cementing sleeves 1008 (open/close) as desired for either stimulation or zone isolation.

What is claimed is:

1. A method of controlling tensile-split conduits in a subterranean geothermal formation, comprising:

providing an injection well extending from a surface to a subterranean geothermal formation, wherein the injection well comprises a first horizontal lateral, wherein the first horizontal lateral comprises a first plurality of cemented casing sleeves, wherein each of the first plurality of cemented casing sleeves is capable of being opened, closed, or choked;

providing a production well extending from the surface to the subterranean geothermal formation, wherein the production well comprises a second horizontal lateral, wherein the second horizontal lateral comprises a second plurality of cemented casing sleeves, wherein each of the second plurality of cemented casing sleeves is capable of being opened, closed, or choked, and further wherein the second horizontal lateral is approximately parallel to the first horizontal lateral, and further wherein the length of the second horizontal lateral is approximately equivalent to the length of the first horizontal lateral;

opening one or more of the first plurality of cemented casing sleeves in the injection well for injection of a tensile-splitting fluid into a production zone, wherein the production zone is defined within the subterranean geothermal formation, and further wherein the production zone requires tensile-splitting to enhance fluid conductivity;

opening one or more of the second plurality of cemented casing sleeves in the production well for injection of the tensile-splitting fluid into the production zone;

creating a first tensile-split conduit by injecting the tensile-splitting fluid into the production zone of the injection well, wherein a first initiation point of the first tensile-split conduit is no closer to any other initiation point of the injection well for any other tensile-split conduits than the length of the first tensile-split conduit between the injection well and the production well, and further wherein the length of the first tensile-split conduit is at minimum slightly more than the distance halfway between the first horizontal lateral and the second horizontal lateral;

creating a second tensile-split conduit by injecting the tensile-splitting fluid into the production zone of the production well, wherein a second initiation point for the second tensile-split conduit is no closer to any other initiation point of the production well for any other tensile-split conduits than the length of the second tensile-split conduit between the injection well and the production well, and further wherein the length of the second tensile-split conduit is at minimum slightly more than the distance halfway between the first horizontal lateral and the second horizontal lateral, and further wherein the placement of the second initiation point is approximately perpendicular to the first tensile-split conduit of the injection well;

monitoring the pressure in the injection well and the production well;

establishing fluid communication between the injection well and the production well;

injecting proppants into the injection well;

bleeding pressure to just below the tensile-splitting extension pressure and above the hydro-shearing pressure maintaining the first tensile-split conduit and the second tensile-split conduit in the open position; and producing the heated fluid to the surface, wherein the heated fluid is employed as direct heat or for electricity generation.

2. The method of claim 1, wherein the creating of the first tensile-split conduit occurs first.

3. The method of claim 1, wherein the creating of the second tensile-split conduit occurs first.

4. The method of claim 1, wherein the creating of the first tensile-split conduit and the second tensile-split conduit alternates until both tensile-split conduits are completed and connected to each other.

5. The method of claim 1, wherein a plurality of the first tensile-split conduit and a plurality of the second tensile-split conduits are created.

6. The method of claim 1, wherein after the stimulation of the injector well and before the stimulation of the producer well, pressure slightly below the fracture initiation pressure is held on the injector well while stimulation of the producer well is executed.

7. The method of claim 1, wherein the proppant comprises sand, bauxite, resin-coated sand, or cement.

8. The method of claim 1, wherein the method further comprises performing an injection test after proppant is injected.

9. The method of claim 1, wherein the distance separating the producer well and the injector well is less than 20 feet on a line parallel to $\sigma_{HMax}$.

10. The method of claim 1, wherein the method further comprises monitoring the stimulation of the injector well and the producer well employing real-time downhole sensor data.

11. The method of claim 1, wherein the method further comprises recovering the tensile-splitting fluid from the producer well and reusing the tensile-splitting fluid from the producer well.

* * * * *